US010160573B2

(12) United States Patent
Borges

(10) Patent No.: US 10,160,573 B2
(45) Date of Patent: Dec. 25, 2018

(54) PACKAGING SYSTEM

(71) Applicant: Erin Borges Designs LLC, Del Rey Oaks, CA (US)

(72) Inventor: Erin Colleen Borges, Del Rey Oaks, CA (US)

(73) Assignee: Erin Borges Designs LLC, Del Rey Oaks, CA (US)

( * ) Notice: Subject to any disclaimer, the term of this patent is extended or adjusted under 35 U.S.C. 154(b) by 2 days.

(21) Appl. No.: 15/494,336

(22) Filed: Apr. 21, 2017

(65) Prior Publication Data

US 2017/0225840 A1 Aug. 10, 2017

Related U.S. Application Data

(62) Division of application No. 14/977,622, filed on Dec. 21, 2015, now Pat. No. 9,821,929.

(60) Provisional application No. 62/130,720, filed on Mar. 10, 2015.

(51) Int. Cl.

| | |
|---|---|
| ***B65D 85/00*** | (2006.01) |
| ***B65D 33/00*** | (2006.01) |
| ***B65D 33/12*** | (2006.01) |

(52) U.S. Cl.

CPC ..... *B65D 33/004* (2013.01); *B65D 33/12* (2013.01)

(58) Field of Classification Search

USPC ..... 383/4, 33, 80, 93, 96, 78; 206/457

See application file for complete search history.

(56) References Cited

U.S. PATENT DOCUMENTS

| | | | | |
|---|---|---|---|---|
| 2,721,023 | A | 10/1955 | Phipps | |
| 3,145,908 | A | 8/1964 | Smith | |
| 4,374,877 | A | 2/1983 | Cole | |
| 4,379,797 | A | 4/1983 | Cole | |
| 4,608,283 | A | 8/1986 | White | |
| 4,657,176 | A | 4/1987 | Matsubara | |
| 4,809,353 | A * | 2/1989 | Cheng | B65D 33/06 383/14 |
| 4,867,577 | A | 9/1989 | Cheng | |
| 4,930,903 | A | 6/1990 | Mahoney | |
| 4,932,556 | A | 6/1990 | Hui et al. | |
| 5,441,348 | A | 8/1995 | Valentino | |
| 5,456,062 | A | 10/1995 | Wechsler | |
| 5,573,437 | A | 11/1996 | Van Dyke et al. | |

(Continued)

FOREIGN PATENT DOCUMENTS

| | | |
|---|---|---|
| WO | WO-2014/137481 A1 | 9/2014 |
| WO | WO-2015/103368 A1 | 7/2015 |

OTHER PUBLICATIONS

US 5,338,241, 08/1994, Van Dyke et al. (withdrawn)

(Continued)

*Primary Examiner* — Jacob K Ackun

(74) *Attorney, Agent, or Firm* — Cooley LLP

(57) ABSTRACT

Described herein are packaging systems having a receptacle and one or a plurality of expandable members that are configured to move from a collapsed configuration to an expanded configuration. In some variations the expandable member includes one or a plurality of folded pieces of material (e.g., tissue paper or fabric (e.g., tulle)), which are attached to the receptacle. In the expanded configuration, the expandable member(s) obscure an object (e.g., a gift) placed within the receptacle without closing the receptacle.

15 Claims, 31 Drawing Sheets

(56) References Cited

U.S. PATENT DOCUMENTS

| | | | | |
|---|---|---|---|---|
| 5,608,949 | A | 3/1997 | Cooley et al. | |
| 5,613,312 | A | 3/1997 | Crowell | |
| 5,836,095 | A | 11/1998 | Crowell | |
| 6,012,842 | A | 1/2000 | Openiano | |
| 6,045,263 | A | 4/2000 | Keller et al. | |
| 6,146,018 | A | 11/2000 | Keller et al. | |
| 6,877,704 | B2 | 4/2005 | Novak et al. | |
| 7,152,369 | B2 | 12/2006 | Weder | |
| 7,243,809 | B2 | 7/2007 | Bezar | |
| 7,614,204 | B2 | 11/2009 | Bezar | |
| 7,905,388 | B2 | 3/2011 | Bowman | |
| 8,696,203 | B2 | 4/2014 | Rednour et al. | |
| 9,033,577 | B2 | 5/2015 | Rednour et al. | |
| 9,044,992 | B1 | 6/2015 | Miller | |
| 2002/0170950 | A1* | 11/2002 | Escamila | B65D 5/10 229/116.1 |
| 2004/0197032 | A1 | 10/2004 | Clark | |
| 2006/0060488 | A1* | 3/2006 | Rodriguez | B65D 51/245 206/457 |
| 2007/0007167 | A1 | 1/2007 | Petter | |
| 2009/0226121 | A1* | 9/2009 | Veder | B65D 31/10 383/210 |
| 2010/0080494 | A1 | 4/2010 | Pavlu, Jr. et al. | |
| 2011/0058756 | A1 | 3/2011 | Underhill | |
| 2011/0243480 | A1 | 10/2011 | Cowman | |
| 2012/0033897 | A1 | 2/2012 | Lahr Yoder | |
| 2012/0051669 | A1 | 3/2012 | Keller | |
| 2014/0183252 | A1* | 7/2014 | Glass | B65D 5/02 229/126 |
| 2014/0190850 | A1* | 7/2014 | Glass | B42D 15/045 206/232 |
| 2014/0194268 | A1 | 7/2014 | Middlemas et al. | |
| 2015/0055893 | A1 | 2/2015 | Schumacher | |
| 2016/0264303 | A1 | 9/2016 | Borges | |

OTHER PUBLICATIONS

Final Office Action dated Oct. 5, 2016, for U.S. Appl. No. 14/977,622, filed Dec. 21, 2015, 10 pages.

Final Office Action dated May 25, 2017, for U.S. Appl. No. No. 14/977,622, filed Dec. 21, 2015, 6 pages.

Non-Final Office Action dated Jun. 24, 2016, for U.S. Appl. No. 14/977,622, filed Dec. 21, 2015, 8 pages.

Notice of Allowance dated Mar. 8, 2017, for U.S. Appl. No. 14/977,622, filed Dec. 21, 2015, 7 pages.

Notice of Allowance dated Oct. 16, 2017, for U.S. Appl. No. 14/977,622, dated Dec. 21, 2015, 8 pages.

* cited by examiner

PACKAGING SYSTEM

CROSS-REFERENCE TO RELATED APPLICATIONS

This application is a divisional of U.S. application Ser. No. 14/977,622, filed Dec. 21, 2015, now U.S. Pat. No. 9,821,929 issued on Nov. 21, 2017, and titled "Packaging System," which claims priority to U.S. Provisional Application Ser. No. 62/130,720, filed Mar. 10, 2015, and titled "A Gift Bag with Tissue Paper Installation," each of which is hereby incorporated by reference in its entirety.

FIELD

The present invention is directed to a packaging system comprising one or more expandable members attached to an open top portion of receptacle and movable from a collapsed configuration to an expanded configuration.

BACKGROUND

Bags and other receptacles are widely used for packaging gifts or other objects of various sizes. The popularity of gift bags stems from ease of use and a wide range of styles, colors, and sizes available. However, gift bags and similar receptacles having open tops may not effectively conceal the object(s) inside of the receptacle. To address this problem, tissue paper is often placed within the receptacle along with the object(s) to obscure the object(s) and/or to provide a decorative appearance. However, the separate placement of tissue paper within the receptacle can be time consuming, requires separately obtaining both a receptacle and the tissue paper, and without proper technique and skill can result in an unattractive appearance and may not effectively conceal the contents of the receptacle. Moreover, a large portion of tissue paper placed with a receptacle may not be visible, and thus a significant amount of tissue paper used may not contribute to obscuring the object(s) and/or to providing a decorative appearance, and as such may be wasted. Thus, it would be desirable to have a packaging system that addresses these problems.

SUMMARY

Described herein are packaging systems having a receptacle and one or a plurality of expandable members that are configured to move from a collapsed configuration to an expanded configuration. In some variations the expandable member includes one or a plurality of folded sheets of material (e.g., paper (e.g., tissue paper, crepe paper), fabric (e.g., organza, tulle), polyester film (e.g., Mylar), cellophane, and/or wired ribbon), which are attached to the receptacle. In the expanded configuration, the expandable member(s) obscure a gift or other object placed within the receptacle without closing the receptacle.

In some variations, the packaging systems described herein comprise a receptacle comprising a bottom, a first side, a second side, a third side, a fourth side, and a top opening, wherein the first side opposes the second side and both have a first width, and wherein the third side opposes the fourth side and both have a second width. The packaging system further comprises a first expandable member attached to an interior surface of the first side of the receptacle, and a second expandable member attached to an interior surface of the second side of the receptacle. The first and second expandable members each comprise a first corner, a second corner, a third corner, and a fourth corner, and a length between the first corner and the third corner, wherein the length is approximately equal to the sum of the first width and the second width. The first and second expandable members each have a collapsed configuration and an expanded configuration, wherein in the collapsed configuration each expandable member is folded. For instance, the expandable member may be accordion-folded into a plurality of sections with the first corner near the second corner and the third corner near the fourth corner in the collapsed configuration. In the expanded configuration, the first corner may be spaced radially away from the second corner, and the third corner may be spaced radially away from the fourth corner and may in some instances be near the first corner. In the expanded configuration, the first and second expandable members obscure a view through the top opening while the top opening remains open. The ratio of the first width measured in inches to the number of sections in the plurality of sections may be about 1:1. In some variations, each of the plurality of sections is fixed to the receptacle at a midpoint along the length of the expandable member. The expandable members may be irreversibly attached to the receptacle, or the expandable members may be removably attached to the receptacle. In some variations where the expandable members are removably attached to the receptacle, each of the expandable member is removably attached to the receptacle via a snap. In some variations the expandable members comprise tissue paper. In other variations the expandable members comprise tulle.

In some variations, the packaging systems described herein comprise a receptacle comprising a bottom, a first side, a second side, and a top opening, wherein the first side opposes the second side and both have a first width, a first expandable member attached to an interior surface of the first side of the receptacle and comprising first and second ends, and a second expandable member attached to an interior surface of the second side of the receptacle and comprising first and second ends. The first and second expandable members each have a collapsed configuration and an expanded configuration. In the expanded configuration, each expandable member partially extends out of the top opening. In the collapsed configuration, each expandable member is located within the receptacle and is accordion-folded into a plurality of sections each having a second width and a length, wherein the ratio of the first width measured in inches to the number of sections is about 1:1, and wherein the ratio of the first width to the length is less than 1:1. In some variations the second width is about 1.5 inches, while in other variations the second width is about 3 inches. In yet other variations the second width is about 2.5 inches. In some variations, in the expanded configuration, at least about 50% of the expandable member extends out of the top opening of the receptacle. Each of the plurality of sections of the first expandable member is attached to a first location on the first side of the receptacle, and each of the plurality of sections of the second expandable member is attached to a second location on the second side of the receptacle. In some variations, a midpoint between the first and second ends of the first expandable member is attached to a midpoint of the first side of the receptacle, and a midpoint between the first and second ends of the second expandable member is attached to a midpoint of the second side of the receptacle. In other variations, each of the plurality of sections of the first expandable member is attached to the first side of the receptacle at the first end of the first expandable member, and each of the plurality of sections of the second expandable member is attached to the second side of the receptacle at the first end of the second expandable member. A section of the first expandable member adjacent to the first side of the receptacle may further be attached to the first side of the receptacle at a location spaced between the first and second ends of the first expandable member, and a section of the second expandable member adjacent to the second side of the receptacle may be attached to the second side of the receptacle at a location spaced between the first and second ends of the second expandable member. In some of these variations, the packaging system further comprises a handle comprising a first end and a second end, wherein the second end is attached to the second end of the first expandable member. The handle comprises a retracted configuration and an extended configuration, and the handle is configured such that movement of the handle from the retracted configuration to the extended configuration moves the first expandable member from the collapsed configuration to the expanded configuration.

In some variations the packaging systems described herein comprise a packaging system comprising a receptacle comprising a bottom, a first side and a second side, wherein the first side opposes the second side and both have a first width. The packaging system further comprises a first expandable member attached to an interior surface of the first side of the receptacle, wherein the first expandable member has a collapsed configuration and an expanded configuration. In the collapsed configuration the expandable member is accordion-folded into a plurality of sections, and each of the plurality of sections is fixed relative to the first side of the receptacle at a midpoint along a length of the section. The packaging system further comprises a second expandable member attached to an interior surface of the second side of the receptacle, wherein the second expandable member has a collapsed configuration and an expanded configuration. In the collapsed configuration the expandable member is accordion folded into a plurality of sections, and each of the plurality of sections is fixed relative to the second side of the receptacle at a midpoint along a length of the section. In some variations, the receptacle comprises a bag. The bag may comprise a material such as paper or fabric. For example, the expandable member may comprise a material such as tissue paper or tulle.

In some variations, the packaging systems described herein are all-in-one designs that may result in cost savings and reduced waste of tissue paper or other wrapping material. In some variations, the packaging systems comprise a bag comprising a front side, a back side parallel to and opposite the front side, left and right sides positioned therebetween, and a bottom panel which closes off one end of the bag. Opposite the bottom panel is an open top to receive items placed into the bag. The bag comprises two handles, with one handle attached to the front side of the bag and one handle attached to the back side of the bag. The system comprises one fan-folded multi-layered expandable member attached at its center to the interior front side of the bag, such as using thread, adhesive, a band, grommet, staple, or the like. The system may further comprise a second fan-folded, multi-layered expandable member attached at its center to the interior back side of the bag, such as using thread, adhesive, a band, grommet, staple, or the like. The expandable members are attached near the opening of the bag. In some variations, the expandable members are attached to the bag such that the handles are located between the expandable members and the front and back of the bag. In other variations, the expandable members are attached to the bag such that the handles are located interiorly relative to the expandable members. In some variations the expandable member comprises tissue paper, which may comprise solid or patterned tissue paper, and which may be fan-folded and die cut at its ends. A user can expand the expandable member by pulling at the corners. In the expanded configuration, the expandable member fills the top of the bag with upright, dense tissue paper. In the expanded configuration, the upper portions of the expandable member can move freely, while the lowest portions of the expandable member are fixed to the bag.

DETAILED DESCRIPTION

Described herein are packaging systems generally comprising a receptacle and pre-attached or attachable expandable members. The expandable members may be folded into a plurality of sections (e.g., "accordion" or "fan" folded) and may be attached to the interior of the receptacle, near a top opening of the receptacle. Each of the plurality of sections may be attached to the receptacle at at least one location, which in some variations may be the midpoint of each section. The expandable members may be movable from a collapsed configuration to an expanded configuration. In a collapsed configuration, the expandable members may be compressed, such that they lie flat against the interior surface of the receptacle. In an expanded configuration, the expandable members may be expanded to extend out of the opening of the receptacle and above the top of the receptacle, in order to create a decorative appearance and to obscure the view of an object (e.g., a gift) located within the receptacle.

Figure 1A:
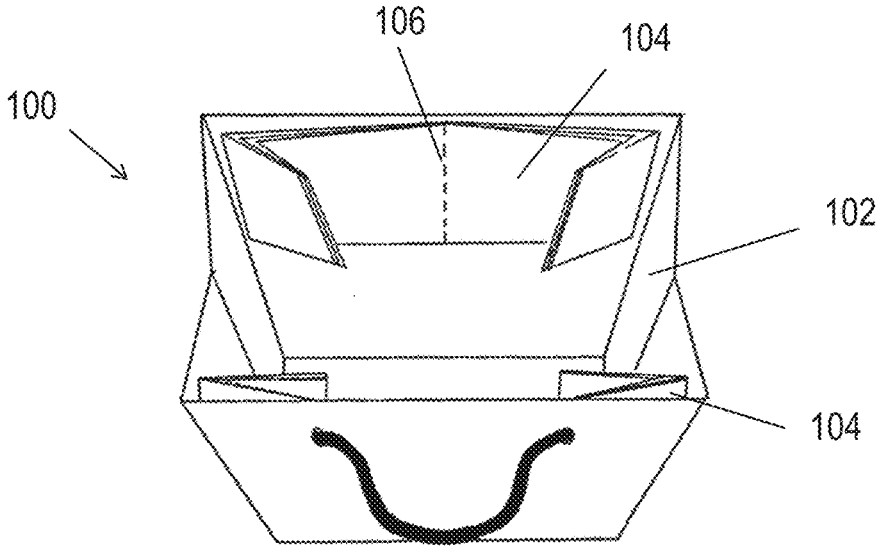
FIGS. 1A-1B show a variation of a packaging system in a collapsed (FIG. 1A) and an expanded (FIG. 1B) configuration.
Figure 1B:
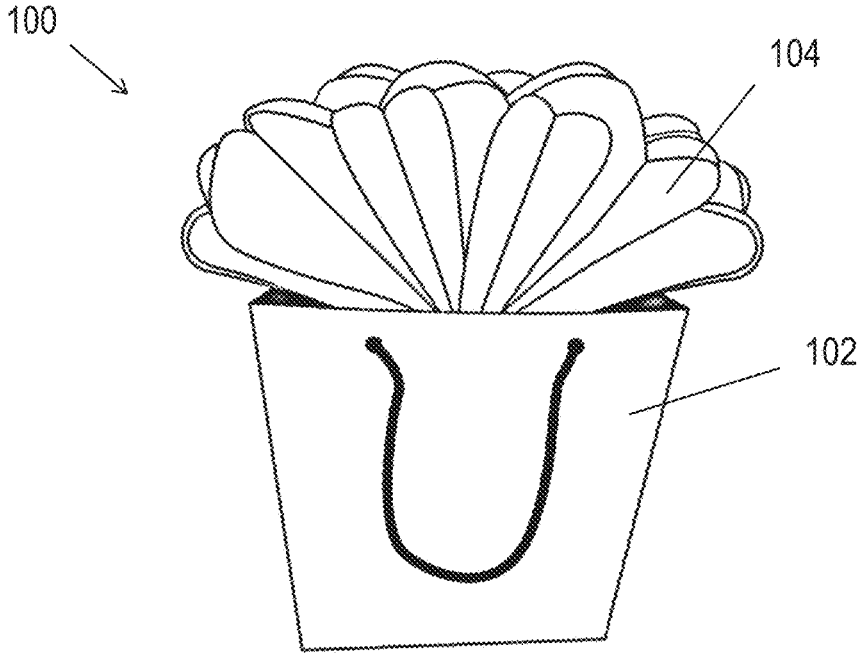

An exemplary packaging system 100 is shown in FIGS. 1A-1B. The packaging system 100 may comprise a receptacle 102 comprising a bag, having two expandable members 104 attached to the interior of the receptacle, near its top opening. The expandable members 104 may be movable from a collapsed configuration (FIG. 1A) to an expanded configuration (FIG. 1B). As shown in FIG. 1A, in the collapsed configuration, each expandable member 104 may be accordion folded into a plurality of sections, and all of the sections may be fixed to the receptacle 102 at midpoint 106 of the expandable member. In the collapsed configuration, the expandable members 104 may be located within the receptacle 102 (i.e., below the top opening of the bag). As shown in FIG. 1B, in the expanded configuration, the expandable members 104 may be expanded to extend out of the top opening of the receptacle 102, and may obscure a view through the top opening.

Receptacle

The receptacles described herein may be any suitable container for holding an object (e.g., a gift) and having an open top. For example, a receptacle may comprise a bag, box, basket, pouch, tote, envelop, or the like. A receptacle may have any suitable shape, such as but not limited to rectangular, circular, oval, triangular, square, or the like. The receptacles described herein may be rigid or flexible, and may be made of any suitable material or materials. For example, a receptacle may comprise paper, cardboard, fabric (e.g., fabrics comprising natural and/or synthetic fibers, such as a fabric comprising one or more of cotton (e.g., canvas), silk, polyester, polypropylene, nylon, hemp, jute or the like), plastic, leather (e.g., suede), foamboard, or the like. The receptacles may be configured to be disposable, or the receptacles may be configured to be reusable. In variations in which the receptacle is configured to be reusable, the expandable member may be configured to be reusable or replaceable, as described in more detail herein.

Figure 2:
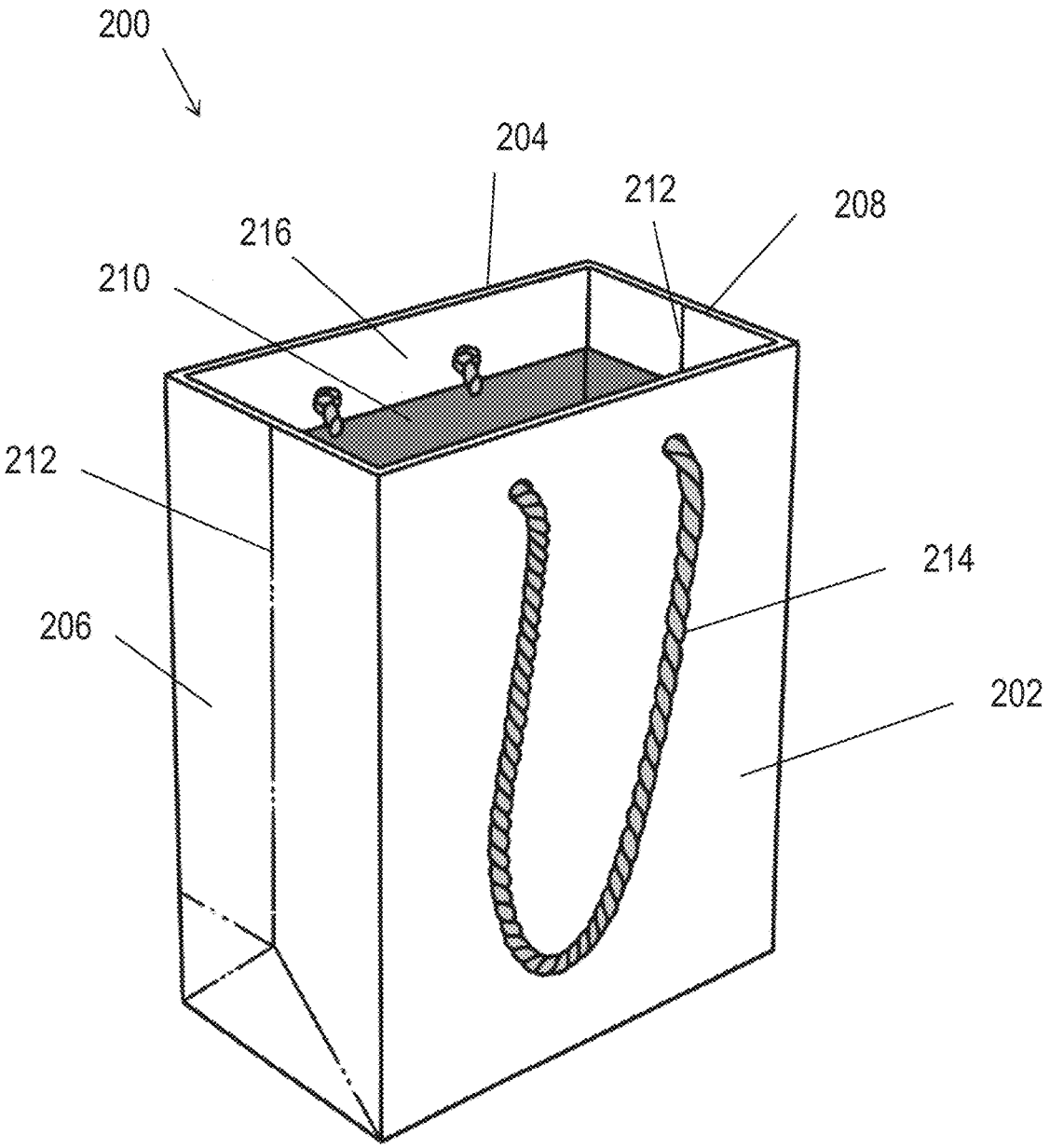
FIG. 2 shows a variation of a receptacle comprising a bag.

In one exemplary variation shown in FIG. 2, the receptacle may comprise a bag 200 having a front side 202, a back side 204 opposite the front side, and left and right sides 206 and 208 extending therebetween, which determine the depth of the bag. A bottom panel may connect each of the front 202, back 204, and left 206 and right 208 sides to create a closed bottom end. An opening 210 may be opposite the bottom panel, which may allow insertion of a gift or other object(s) into the bag 200. The left 206 and right 208 sides may each comprise a vertical bisecting crease or fold line 212, which may allow the bag 200 to be folded flat. The bag 200 may further comprise a turn-top 216, which may extend around the top perimeter of the bag and may comprise a reinforcement panel.

The bag may optionally comprise handles. For example, the bag 200 shown in FIG. 2 comprises a two handles 214. One handle may be attached to the front side 202 of the bag, and one handle may be attached to the back side 204 of the bag. The handles 214 may comprise rope as shown, or may comprise another suitable material, such as ribbon, paper (e.g., flat paper or twisted paper), plastic, metal (e.g., wire), or the like. The handles may be attached by any suitable method, such as by extending through the front and back sides of the bag and any turn-top and then terminating in a knot, as shown in FIG. 2, or by attachment via glue or other adhesive to the front and back sides of the bag and/or turn top, or the like.

When the receptacle comprises one or more handles, it may be desirable that the handles have sufficient length to extend beyond an expandable member when the expandable member is in an expanded configuration. For example, when an expandable member has a length l (which may be equal to the sum of the width and depth of the receptacle, as described in more detail herein) and is attached to the receptacle at its midpoint as described in more detail herein, the handles may desirably be configured to extend at least about ½ l above the top of the receptacle. When the handles are attached at either end near the top of the receptacle, the handles may thus desirably have at least the same length as the expandable member, i.e., have a length of at least l.

Figure 20:
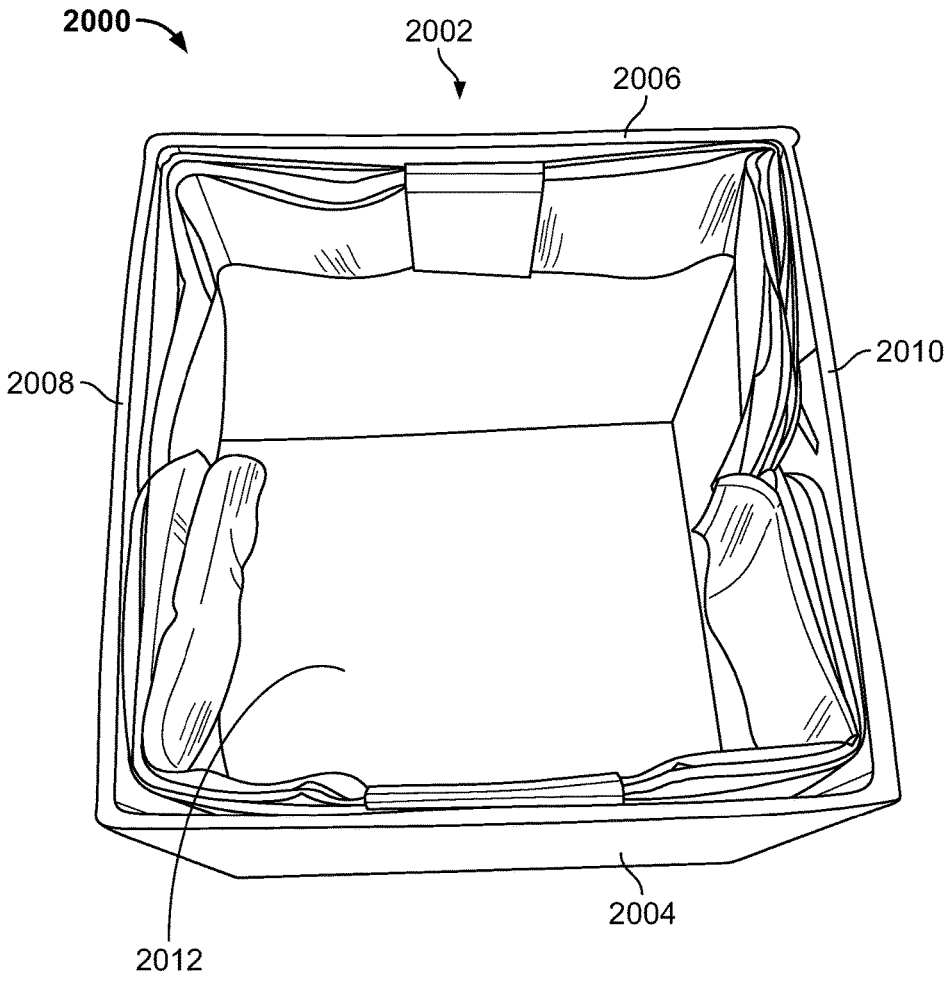
FIG. 20 shows a variation of a packaging system comprising a receptacle comprising a box.

FIG. 20 shows an exemplary variation of a packaging system 2000 wherein the receptacle comprises a box 2002. The box 2002 may comprise a front side 2004, a back side 2006 opposite the front side, and left and right sides 2008 and 2010 extending therebetween, which may determine the depth of the box. A bottom panel may connect each of the front 2004, back 2006, and left 2008 and right 2010 sides to create a closed bottom end. An opening 2012 may be opposite the bottom panel of box 2002, which may allow insertion of a gift or other item into the box.

Expandable Member

The receptacles described herein may have one or more expandable members attached or attachable to the receptacle. The expandable member may be movable from a collapsed configuration, in which it is compressed and configured to lie against an interior surface of the receptacle, to an expanded configuration, in which it may extend out of and above the top opening of the receptacle.

Material

The expandable member may comprise one or more layers of material. It may be desirable that the expandable member comprise a plurality of layers of material, such that in the expanded configuration, the expandable member adequately obscures the view of an object (e.g., a gift) located within the receptacle. In some variations, a plurality of layers of material may also help to keep the layers of material extended upwards in the expanded configuration. In one variation, for example, the expandable member comprises two layers of tissue paper. In an expanded configuration, two layers of tissue paper may be sufficient for a full appearance and to conceal an object located within the receptacle, while avoiding unnecessary use of tissue paper.

However, it should be appreciated that one-ply expandable members (i.e., having a single layer) or expandable members comprising more than two (e.g., three, four, five, six, seven, eight, nine, ten, eleven, twelve, thirteen, fourteen, fifteen, sixteen, seventeen, eighteen, nineteen, twenty, or more) layers of material may be used. The material may have any suitable pattern or color, which may in some instances be configured to match a pattern or color of the receptacle.

The expandable members described herein may comprise any suitable material or materials. For example, the expandable member may comprise materials including but not limited to tissue paper, tulle, polyester film (e.g., Mylar), cellophane, crepe paper, organza, and/or wired ribbon, or the like. When an expandable member comprises a plurality of layers, in some variations each layer of the expandable member may comprise the same material as each other layer of the expandable member, while in other variations at least one of the layers may comprise a different material. For example, an expandable member may comprise two layers, with one layer comprising tissue paper and one layer comprising tulle. In other variations of expandable members comprising a plurality of layers, one or more layers may have a different appearance (e.g., color, pattern, end shape, texture, thickness, or the like).

The material may have any thickness and weight suitable for the desired appearance and function described herein. When the material comprises tissue paper, the tissue paper may be any suitable type of tissue paper, such as standard tissue paper, silk or satin wrap tissue paper, and/or waxed tissue paper, for example. In some variations, the tissue paper may have a weight of between about 15 and about 40 grams per square meter. In some of these variations, the tissue paper may have a weight of between about 10 and about 50 grams per square meter. In some of these variations, the tissue paper may have a weight of about 17 grams per square meter, or about 20 grams per square meter. In other variations, the tissue paper may have a weight of between about 20 and about 40 grams per square meter. For example, the tissue paper may have a weight of between about 20 and about 36 grams per square meter. As another example, the tissue paper may have a weight of about 40 grams per square meter. In variations in which the packaging system is intended to be reusable, it may be desirable for the tissue paper to be thicker/heavier to allow for repeated expansion and collapse. In other variations, it may be desirable to have thinner tissue paper. In all instances, it may be desirable that the tissue paper have sufficient properties to remain in the expanded configuration after expansion.

Figure 3A:
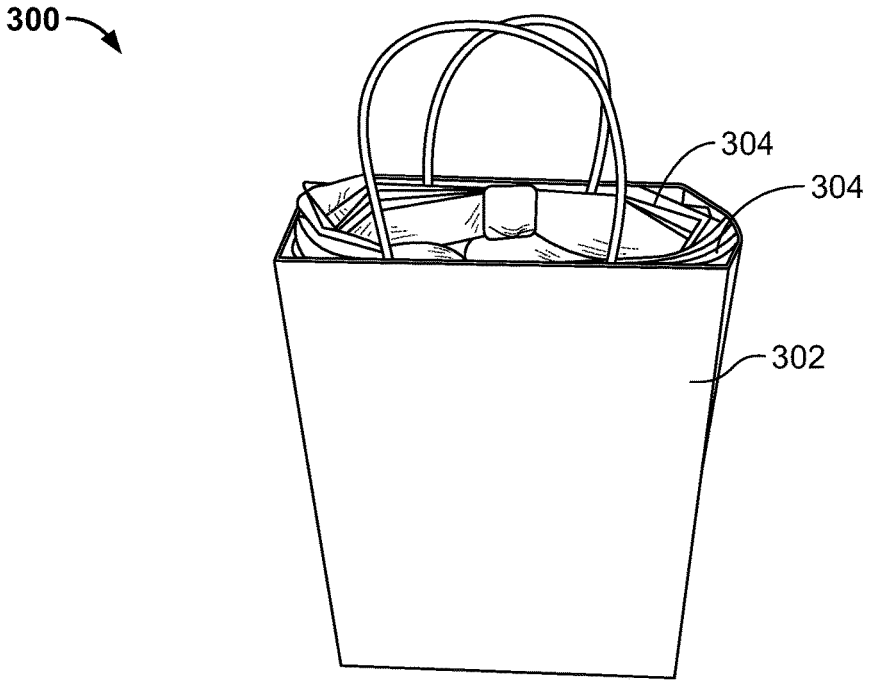
FIGS. 3A-3D show a variation of a packaging system having an expandable member comprising tulle.
Figure 3B:
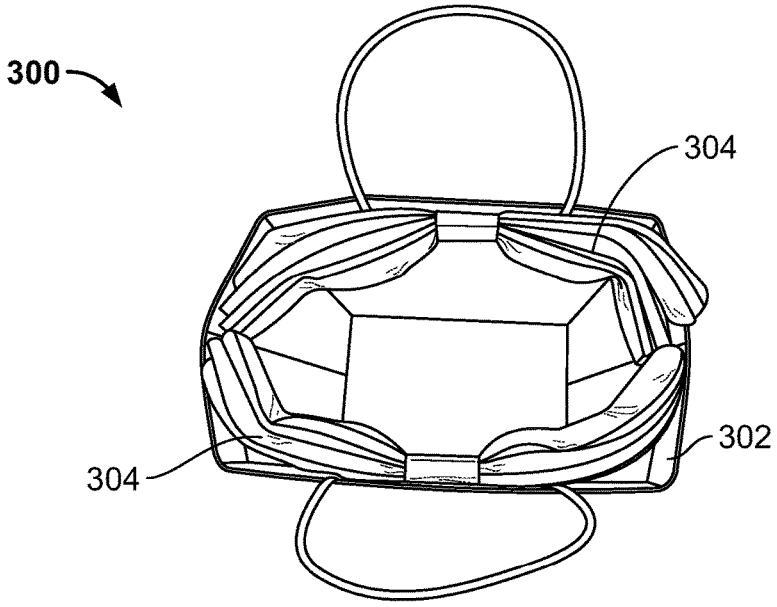
Figure 3C:
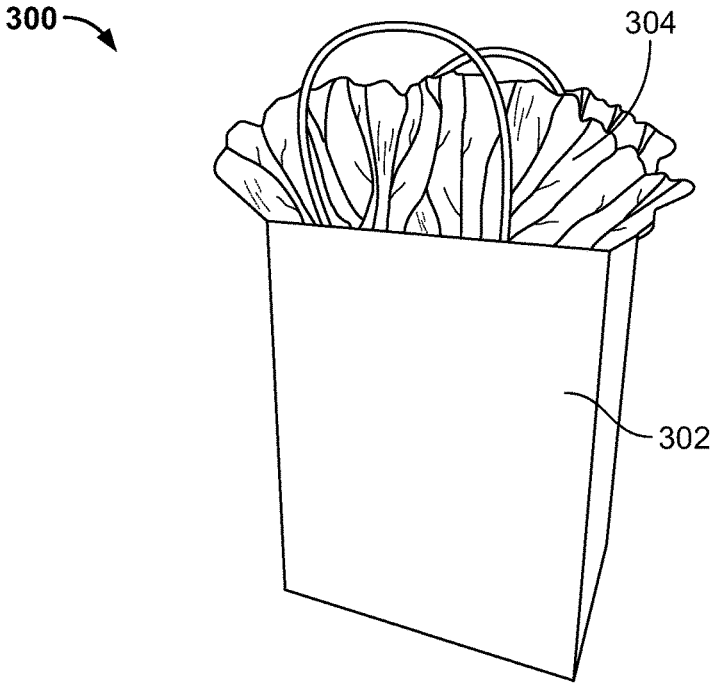
Figure 3D:
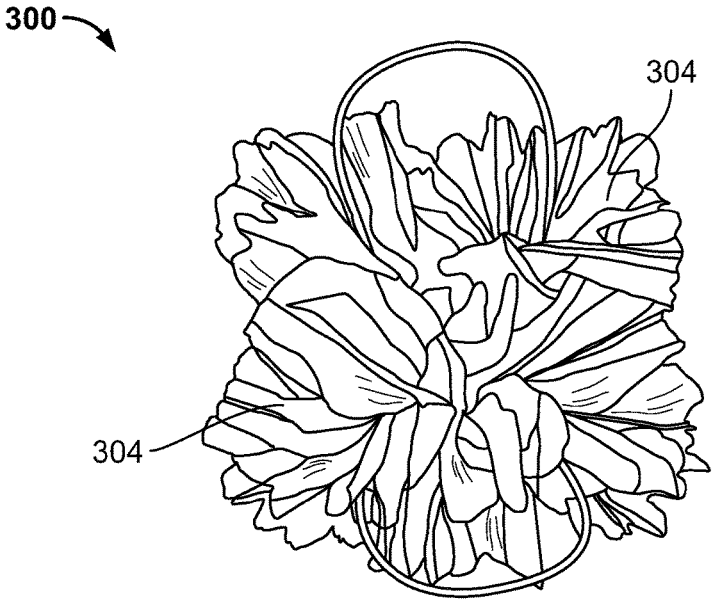

An exemplary packaging system 300 wherein an expandable member comprises tulle is shown in FIGS. 3A-3D. FIGS. 3A and 3B show side and top views, respectively, of a receptacle comprising a bag 302 having two attached expandable members 304, in a collapsed configuration. Each expandable member as shown comprises six layers of tulle. FIGS. 3C and 3D show perspective front and top views, respectively, of the packaging system 300 with the expandable members 304 in an expanded configuration. While shown with six layers, the expandable members 304 of packaging system 300 may comprise other numbers of layers of tulle, such as but not limited to one, two, three, four, five, six, seven, eight, nine, ten, eleven, twelve, thirteen, fourteen, fifteen, sixteen, seventeen, eighteen, nineteen, twenty, or more layers of tulle. Depending on the thickness and stiffness of the tulle, it may be desirable in some variations to have at least five layers of tulle in order to conceal any contents of the bag and to keep the tulle in an expanded configuration after expansion.

Dimensions

Figure 4A:
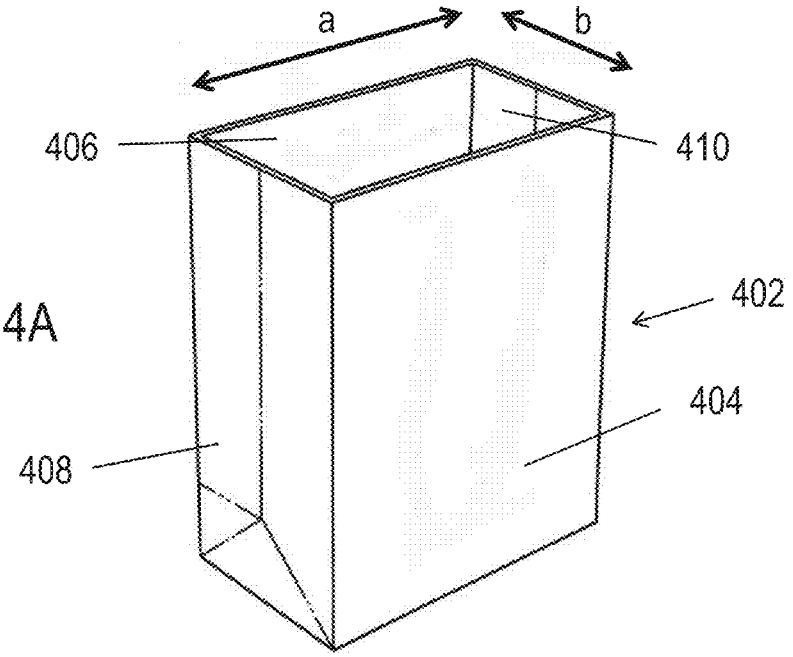
FIGS. 4A-4C show components of a variation of a packaging system.
Figure 4B:
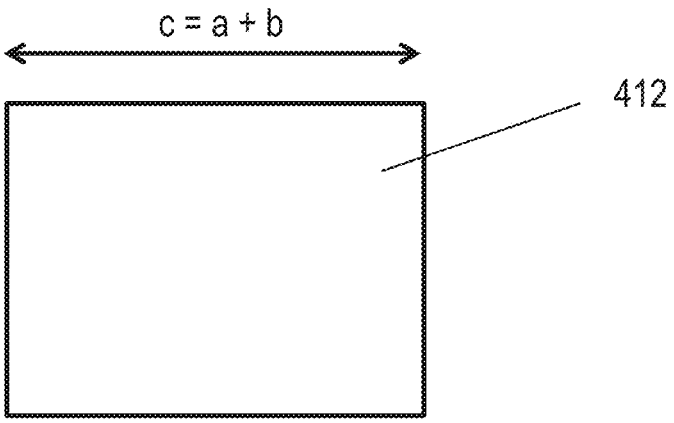
Figure 4C:
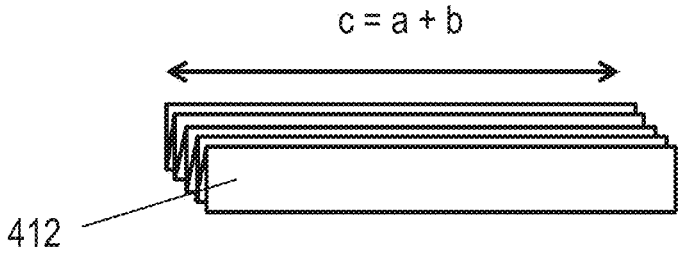

The one or more layers of material comprising the expandable member may have dimensions appropriate for the dimensions of the receptacle. It is preferable that the length of the expandable member be longer than the width of the portion of the receptacle to which it is attached. More particularly, the expandable member may have a length that is approximately equal to the sum of the width and depth of the receptacle. That is, when the receptacle has a rectangular cross-section, the expandable member may have a length that is approximately equal to the sum of the width of the front or back of the receptacle (the "width" of such a receptacle) and the width of the left or right side of the receptacle (the "depth" of such a receptacle). This relationship between the receptacle dimensions and expandable member dimensions is illustrated in FIGS. 4A-4C. Shown in FIG. 4A is a receptacle comprising a rectangular bag 402 having a width a (i.e., the width of the front and back sides 404 and 406) and a depth b (i.e., the width of the left and right sides 408 and 410). FIG. 4B shows an expandable member 412 having a length c, where c is approximately equal to a+b. Thus, the ratio c:a in this variation is greater than one.

It should be appreciated that although the length of the expandable member may desirably be approximately equal to the sum of the width and depth of the receptacle, this relationship may be slightly varied to accommodate standard manufacturing sizes of the expandable member material. Additionally or alternatively, sheets of the expandable member material(s) may be overlapped to achieve the desired dimensions. For example, when the expandable member comprises tissue paper, multiple sheets of standard size tissue paper of 20×30 inches may be overlapped to achieve an expandable member layer of the desired dimension. For instance, two sheets of 20×30-inch tissue paper may be overlapped to create an expandable member layer having a length between 30 and 60 inches.

Folding

As mentioned above, the expandable member may comprise a collapsed configuration and an expanded configuration. In a collapsed configuration, the expandable member may be folded. For example, the expandable member may be accordion-folded or fan-folded into a plurality of sections. When the expandable member is in the expanded configuration, the appearance of the packaging system may depend on the number of sections into which the expandable member is folded. In order to achieve a result that is aesthetically pleasing and that obscures the view of an object within the receptacle in an expanded configuration when the expandable member is attached to the receptacle in a manner described in more detail herein, the number of sections in an accordion-folded expandable member is desirably approximately equal to the width, in inches, of the receptacle side to which the expandable member is attached. That is, when the expandable member is accordion-folded, the ratio of the number of sections to the width of the receptacle side in inches may be about 1:1. Put yet another way, when the expandable member is attached to the front or back side of a receptacle, the expandable member may be folded into one section per inch of the receptacle's width. As such, when an accordion-folded expandable member is attached to the front or back side of a receptacle having a width of a inches, the expandable member may thus desirably comprise a−1 folds, and be folded into a sections. For instance, in the example shown in FIGS. 4A-4C, the accordion-folded expandable member 412 shown in FIG. 4C is configured to be attached to the front side 404 or back side 406 of the bag 402. In one variation, the front side 404 and back side 406 each have a width of about nine inches. In this variation, the expandable member 412 has eight folds, forming nine sections. Thus, the ratio of the number of sections of the expandable member 412 (nine) to the width of the bag in inches (nine) in this variation is about 1:1.

In some variations, each section of a folded expandable member may have the same width. In other variations, one or more sections may have different widths. It may be desirable for the width of each section to be between about 1 inch and about 5 inches. In some variations, the width of each section may be about 1.5 inches. In other variations, the width of each section may be about 2.5 inches. In some variations, the width of each section may be between about 1 inch and about 3 inches, or between about 1.5 inches and about 2.5 inches. In some variations, the width of each section may be about 1 inch, about 2 inches, about 3 inches, about 3.5 inches, about 4 inches, about 4.5 inches, or about 5 inches. In other variations the width of each section may be less than about 1 inch or more than about 5 inches.

Attachment to Receptacle

An expandable member may be attached to a receptacle. More specifically, an expandable member may be attached to an interior surface of the receptacle, near an open top of the receptacle. When the receptacle comprises a turn-top, the expandable member may be attached to the turn-top. In some variations in which a packaging system comprises two expandable members, the first expandable member may be attached to the interior surface of a first side of the receptacle (e.g., a front side of the receptacle), and the second expandable member may be attached to the interior surface of a second side of the receptacle (e.g., a back side of the receptacle). The first and second sides may in some variations be opposite each other. In order to achieve the intended appearance and function, all of the plurality of sections of the expandable member may be fixed together at at least one location along the length of the expandable member, and the expandable member may be fixed to the receptacle at that same location along the length of the expandable member during use.

Figure 5A:
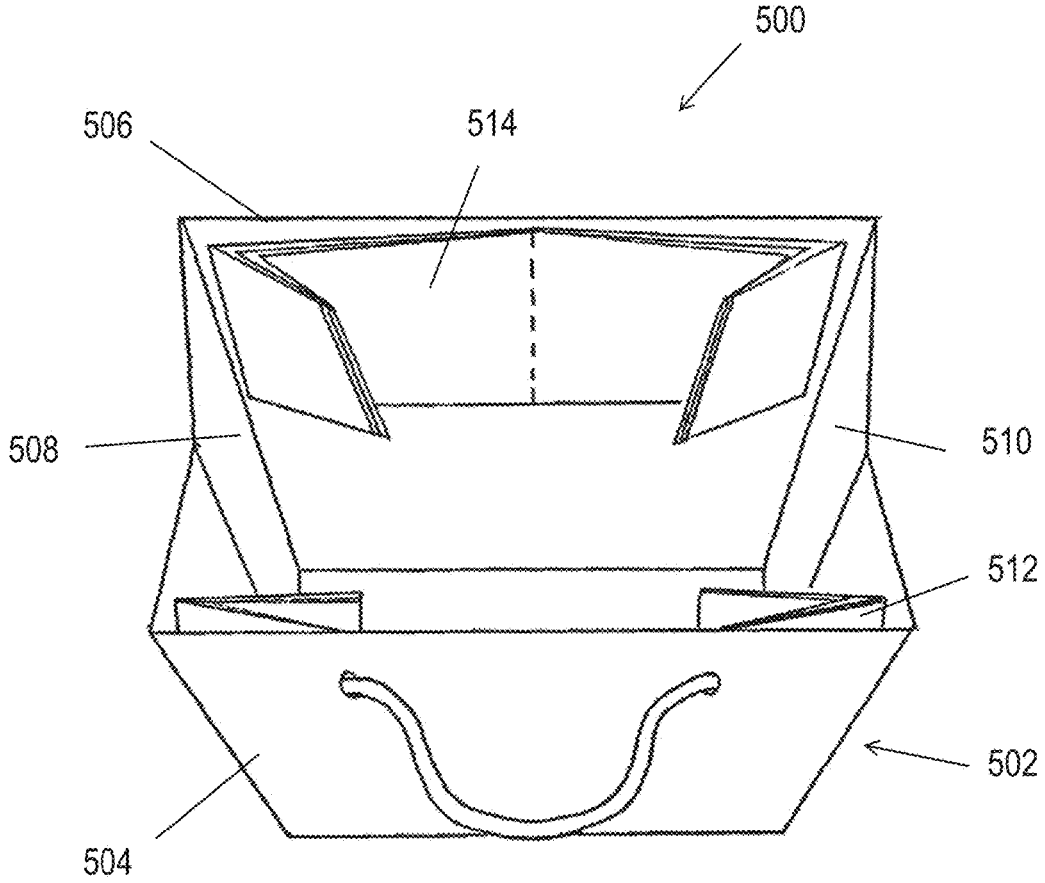
FIG. 5A shows a variation of a packaging system.
Figure 5B:
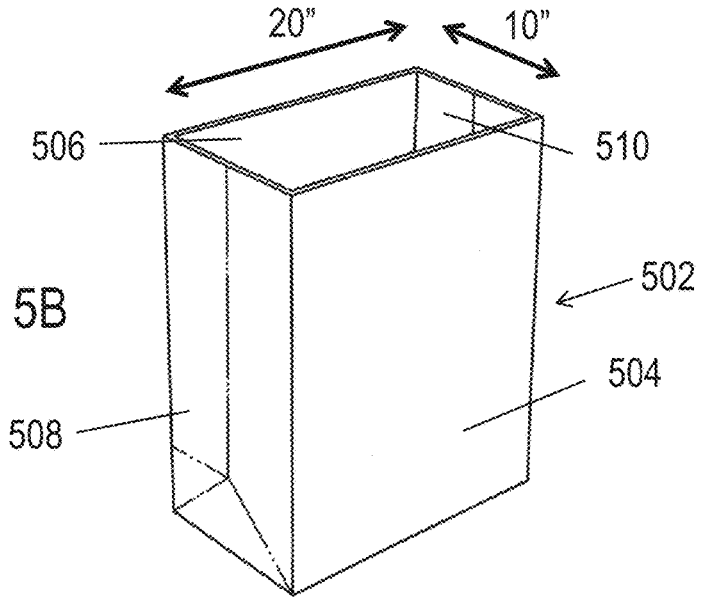
FIGS. 5B-5D show components of the system of FIG. 5A.
Figure 5C:
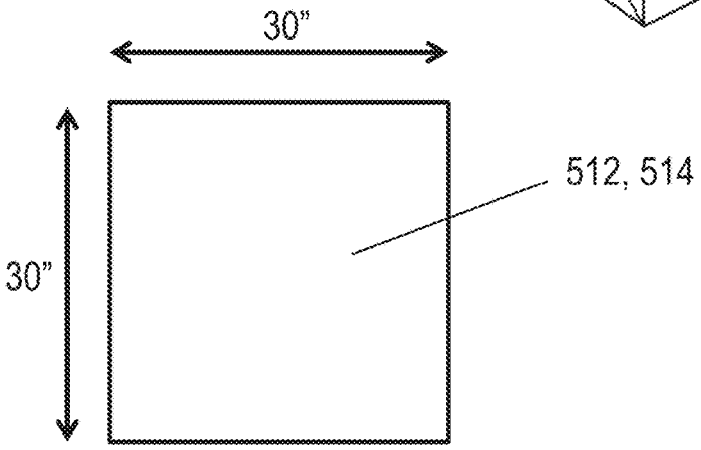
Figure 5D:
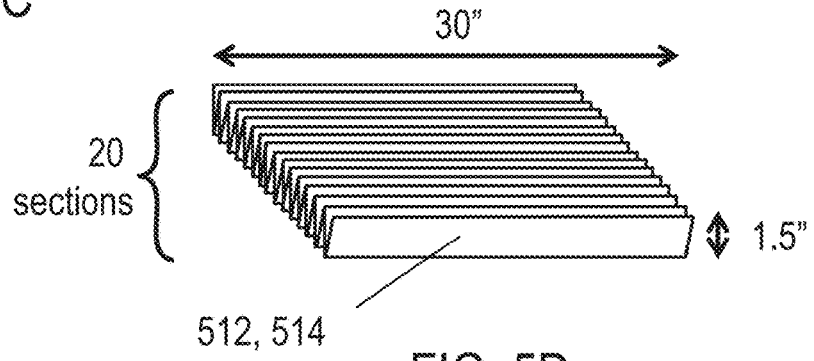

For example, FIGS. 5A-5D show one variation of a packaging system 500. As shown in FIG. 5A, the packaging system 500 comprises a comprises a receptacle comprising a bag 502 and two expandable members 512 and 514. The expandable members 512 and 514 may be reversibly or irreversibly attached to the interior surfaces of the sides of the bag (e.g., the front side and back side, as shown). As shown in FIG. 5B, in one variation the bag 502 has a width of about 20 inches (i.e., the width of front and back sides 504 and 506) and a depth of about 10 inches (i.e., the width of left and right sides 508 and 510). Thus, the top opening of the bag 502 in this variation is about 20 inches by about 10 inches. Each expandable member 512, 514 may comprise any suitable number of layers of material (e.g., two layers of tissue paper), each having a length of about 30 inches and a width of about 30 inches, as shown in FIG. 5C. Each expandable member 512, 514 may be folded into 20 sections, each having a width of about 1.5 inches, as shown slightly expanded in FIG. 5D for illustrative purposes. Thus, in this example, the length of the expandable members 512, 514 (about 30 inches) is greater than the width of the receptacle (about 20 inches) and is approximately equal to the sum (about 30 inches) of the width (about 20 inches) and depth (about 10 inches) of the receptacle. Further, the expandable members 512, 514, are each folded into a number of sections (20) that is approximately the same as the width of the bag 502 in inches (about 20 inches). That is, the ratio of the number of sections (20) to the width in inches (about 20) is about 1:1.

Expandable member 512 in this variation may be attached near the top of the interior surface of a front side 504 of the bag 502 in a horizontal orientation, as shown in FIG. 5A. That is, the length of the expandable member 512 may be approximately parallel to the top of the receptacle. In some variations, the expandable member 512 may be attached to a turn-top of the bag 502. As shown, the expandable member 512 may be attached such that its length extends and is centered along the width of the front side 504 of the receptacle, and such that it is centered along the front side 504 of the receptacle. Each expandable member 512, 514 in this variation may be attached through each section at its midpoint to the midpoint of the side of the receptacle (e.g., via stitching as shown in FIG. 5A, or other methods as described in more detail herein). Because the length of the expandable member 512 is greater than the width of the front side 504, as described in more detail herein, the ends of the expandable member may be folded inward as shown in FIG. 5A to fit within the receptacle. A second expandable member 514 may be similarly attached near the top of the interior surface of a back side 506 of the bag 502 in a horizontal orientation. Thus, the two expandable members 512, 514 may be attached to opposite sides of the bag 502.

Figure 6A:
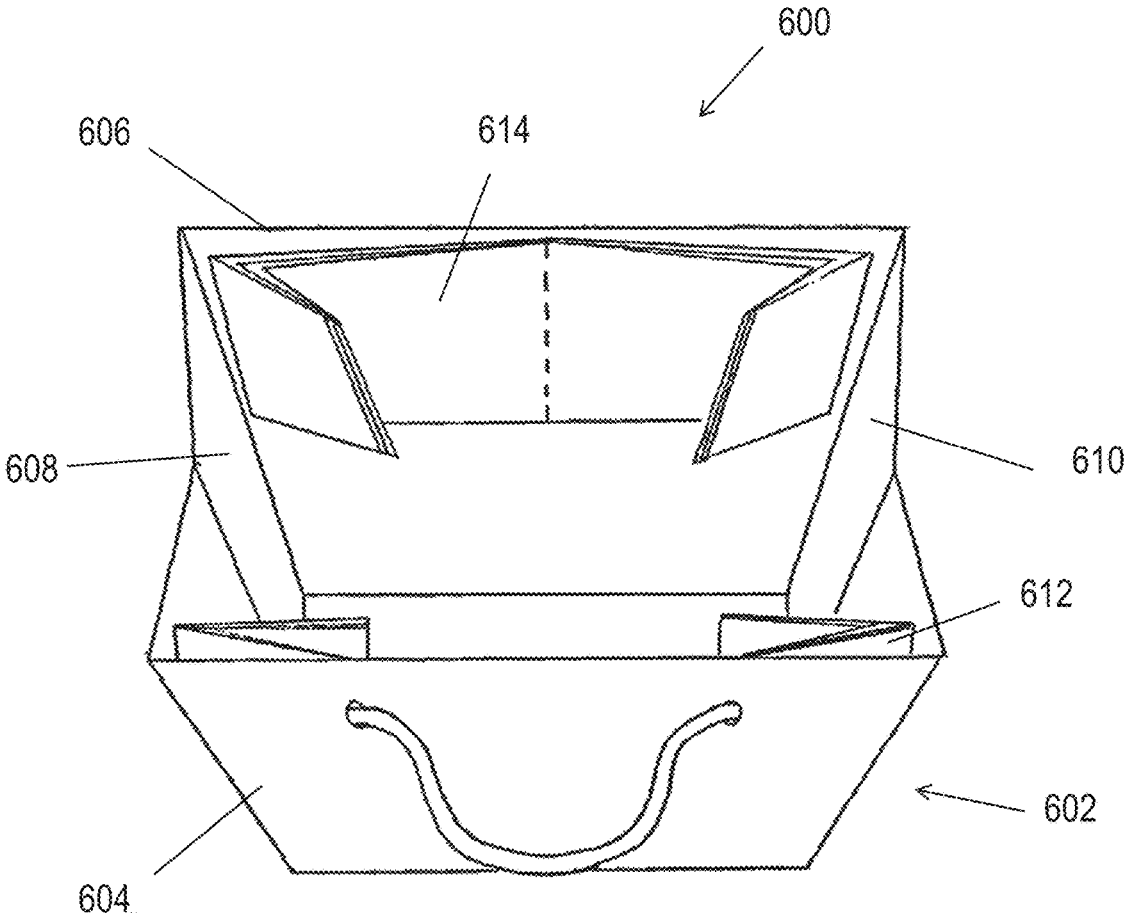
FIG. 6A shows a variation of a packaging system.
Figure 6B:
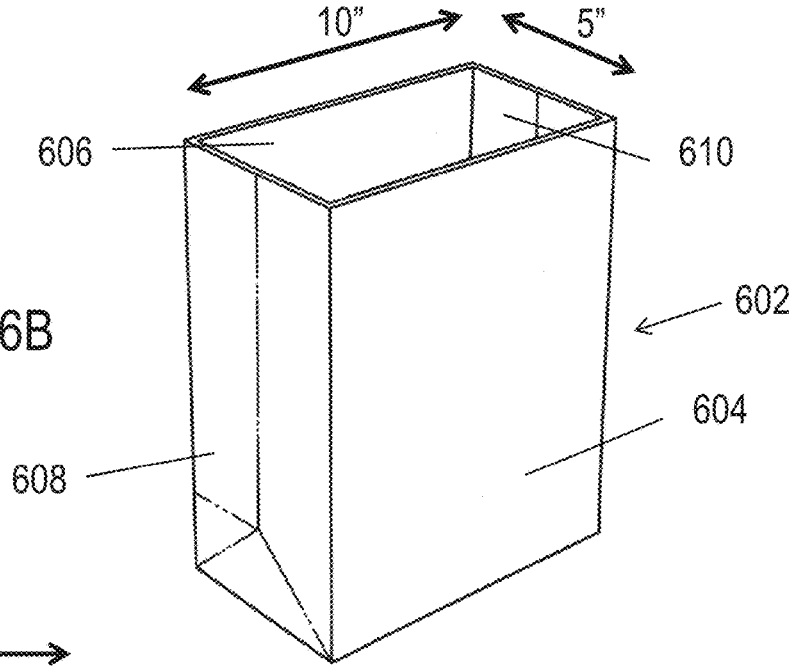
FIGS. 6B-6D show components of the system of FIG. 6A.
Figure 6C:
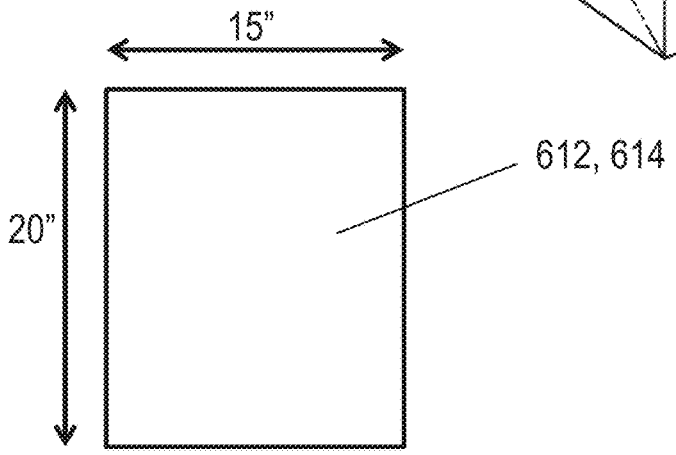
Figure 6D:
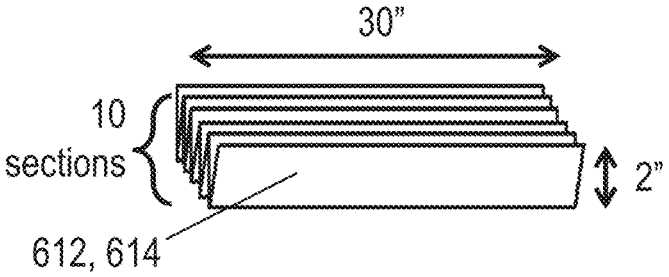

As another example, FIGS. 6A-6D show another variation of a packaging system 600. As shown in FIG. 6A, the packaging system 600 comprises a bag 602 and two expandable members 612, 614. The expandable members 612 and 614 may be reversibly or irreversibly attached to the interior surfaces of the sides of the bag (e.g., the front side and back side, as shown). As shown in FIG. 6B, the bag 602 may have a width of about 10 inches (i.e., the width of front and back sides 604 and 606) and a depth of about 5 inches (i.e., the width of left and right sides 608 and 610). Thus, the top opening of the bag 602 in this variation may be about 10 inches by 5 inches. Each expandable member 612, 614 may comprise any suitable number of layers of material (e.g., two layers of tissue paper), each having a length of about 15 inches and a width of about 20 inches, as shown in FIG. 6C. In some instances in which the material comprises tissue paper, each layer of tissue paper may be formed by cutting in half a standard sheet of tissue paper that is 20×30 inches. In other instances in which the material comprises tissue paper, two layers of the expandable member be formed by folding in half a standard sheet of tissue paper that is 20×30 inches. Each expandable member 612, 614 in this variation may be folded into 10 sections, each having a width of about 2 inches, as shown slightly expanded in FIG. 6D for illustrative purposes. Thus, in this example the length of the expandable members 612, 614 (about 15 inches) is greater than the width of the receptacle and is approximately equal to the sum (about 15 inches) of the width (about 10 inches) and depth (about 5 inches) of the receptacle. Further, the expandable members 612, 614 are each folded into a number of sections (10) that is approximately the same as the width of the bag 602 in inches (about 10 inches). That is, the ratio of the number of sections (10) to the width in inches (about 10) is about 1:1.

The two expandable members 612, 614 may be attached to opposite sides of the bag, i.e., in this variation a first expandable member 612 may be attached to the front side 604, and a second expandable member 614 may be attached to the back side 606 of the bag 602. In this variation, each section of the expandable member 612, 614 is attached at its midpoint to the midpoint of the side of the bag (e.g., via stitching as shown in FIG. 6A, or other methods as described in more detail herein). Each end of the expandable members may be folded inward to fit within the bag 602, similar to the packaging system 500 described with respect to FIGS. 5A-5D.

Figure 8A:
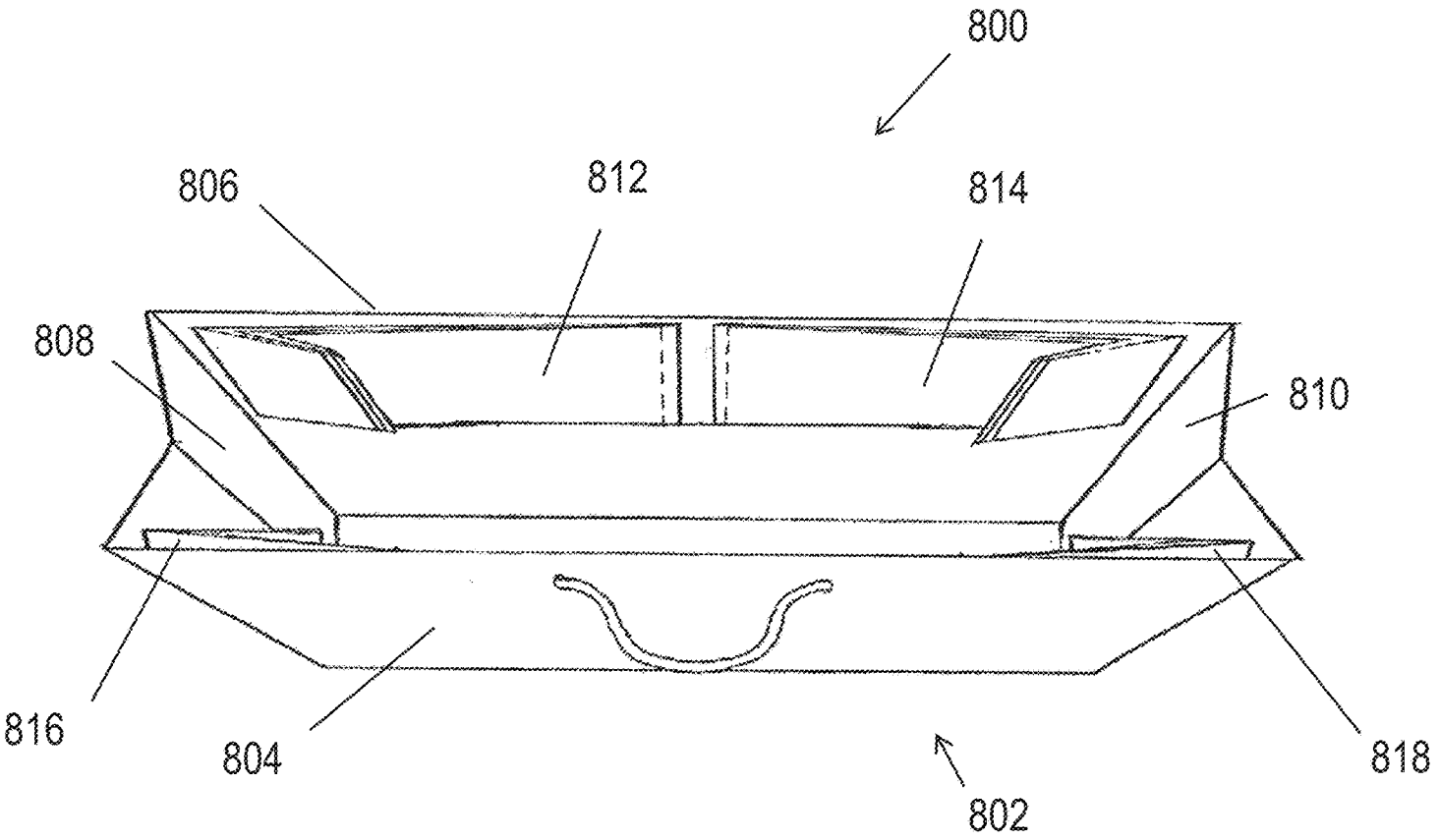
FIG. 8A shows a variation of a packaging system.

It should be appreciated that in certain variations an expandable member may be fixed to a receptacle at an end of the expandable member, rather than at the midpoint of the expandable member. An example is shown in FIGS. 8A-8D, which show a packaging system 800. As shown in FIG. 8A, the packaging system 800 may comprise an oversized bag 802 and four expandable members. A first expandable member 812 may be attached left-of-center to the interior surface of the back side 806 of the bag 802, and a second expandable member 814 may be attached right-of-center to the interior surface of the back side of the bag, both near the open top of the bag. The first and second expandable members 812 and 814 may be attached to the bag 802 at their adjacent ends (e.g., via stitching as shown in FIG. 8A, or other methods as described in more detail herein), near the midpoint of the back side 806 of the bag. The opposite ends of expandable members 812 and 814 may be folded inward to fit within the bag 802. A third expandable member 816 may be attached left-of-center to the interior surface of the front side 804 of the bag 802, and a fourth expandable member 818 may be attached right-of-center to the interior surface of the front side of the bag, both near the open top of the bag. The third and fourth expandable members 816 and 818 may be attached to the bag 802 at their adjacent ends (e.g., via stitching as shown in FIG. 8A, or other methods as described in more detail herein), near the midpoint of the front side 804 of the bag. The opposite ends of the expandable members 816 and 818 may be folded inward to fit within the bag 802.

Figure 8B:
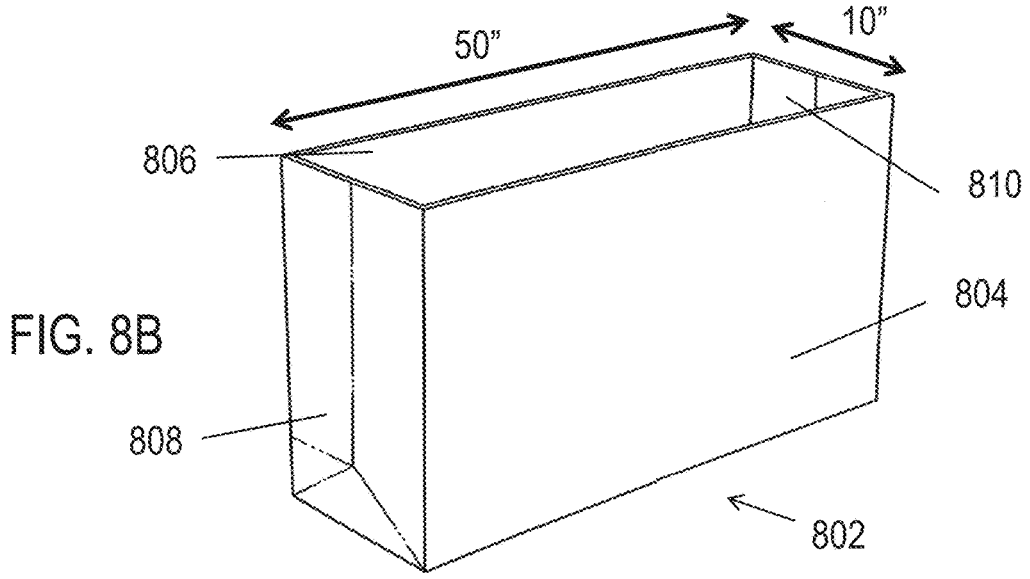
FIGS. 8B-8D show components of the system of FIG. 8A.
Figure 8C:
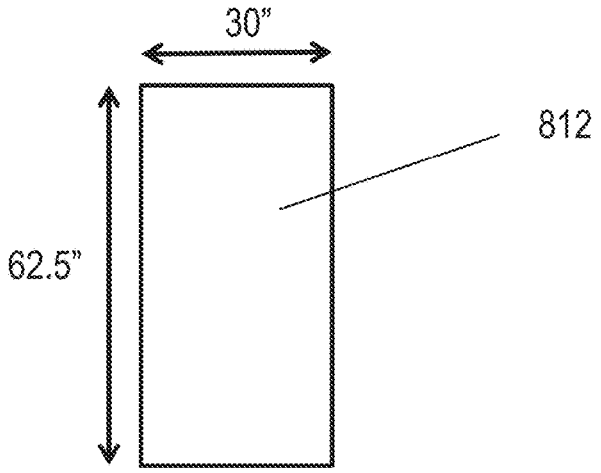
Figure 8D:
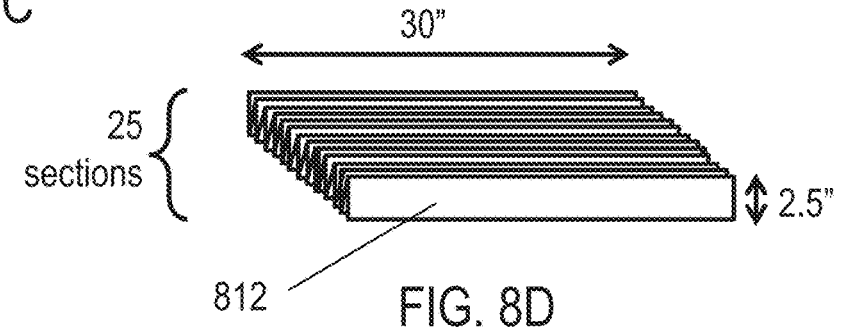

In this variation, it may be desirable that the length of each expandable member be greater than half of the width of the receptacle. More specifically, it may be desirable that the length of each expandable member be approximately equal to half of the sum of the width and depth of the receptacle. That is, if each expandable member has a length d, and the receptacle has width f and depth g, then d may be approximately equal to (f+g)/2. For example, as shown in FIG. 8B, in one variation the bag 802 has a width of about 50 inches (i.e., the width of front and back sides 804 and 806), and a depth of about 10 inches (i.e., the width of left and right sides 808 and 810). Each expandable member 812, 814, 816, 818 may comprise any suitable number of layers of material (e.g., one, two, three, four, or more sheets of tissue paper), where each layer may have a length of about 30 inches and a width of about 62.5 inches, as shown in FIG. 8C. In some instances, each layer may be formed by overlapping four 20×30-inch pieces of tissue paper. Each expandable member in this variation is folded into 25 sections, each having a width of about 2.5 inches, as shown slightly expanded in FIG. 8D for illustrative purposes.

While the exemplary packaging systems described herein, such as packaging systems 500, 600, and 800 are described as comprising particular components, it should be appreciated that the systems may comprise variations of these components as described herein. For example, while each of packaging systems 500, 600, and 800 are described as comprising a receptacle comprising a bag, it should be appreciated that they may comprise other receptacles having the same dimensions, such as but not limited to a box. Similarly, for example, the expandable members may comprise fewer or more sheets of tissue paper, or may comprise another material, such as but not limited to tulle.

Figure 9:
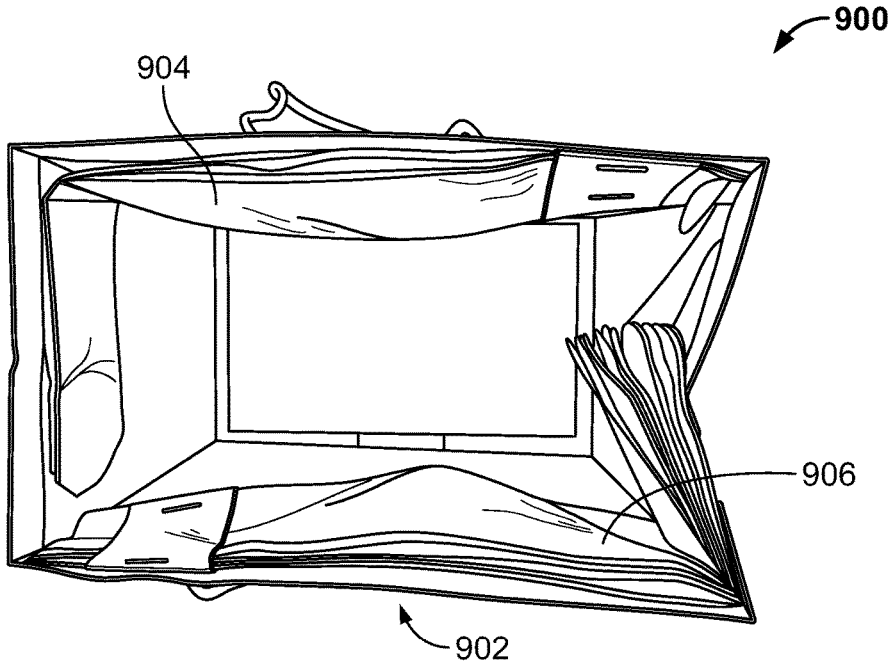
FIG. 9 shows a variation of a packaging system having expandable members attached at the end of the expandable member.

In other variations, a packaging system may comprise one or more expandable members fixed to a receptacle at an end of the expandable member with the end of the expandable member located near the edge of a front, back, or side of the receptacle (i.e., near a corner) rather than a midpoint of a side of the receptacle. For example, FIG. 9 shows a packaging system 900 comprising a receptacle comprising a bag 902 and two expandable members 904 and 906, each attached at an end of the expandable member near a corner of the bag 902.

Figure 10A:
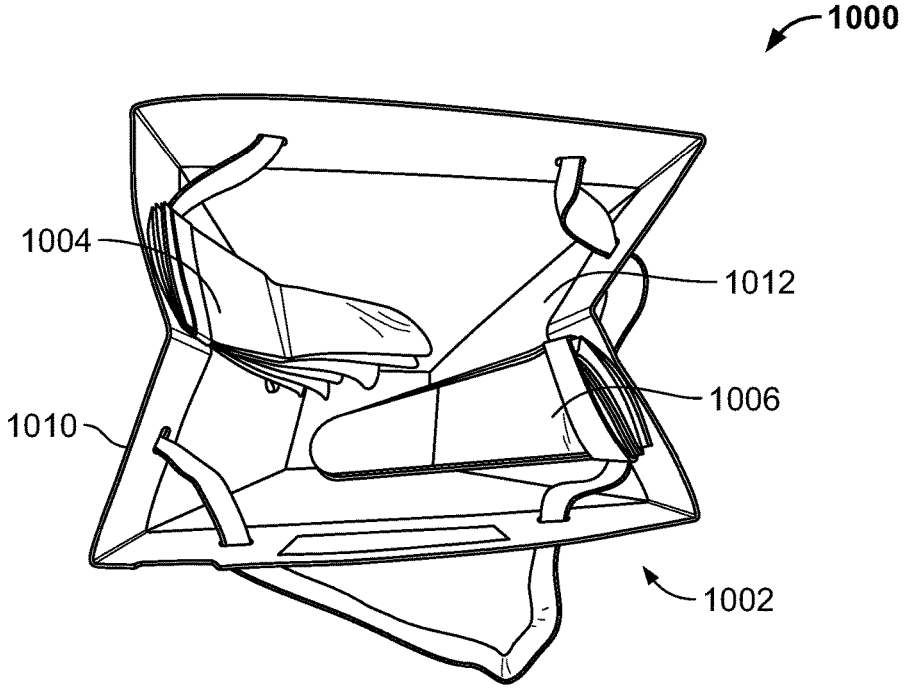
FIG. 10A shows a variation of a packaging system having two expandable members attached vertically to the receptacle.
Figure 10B:
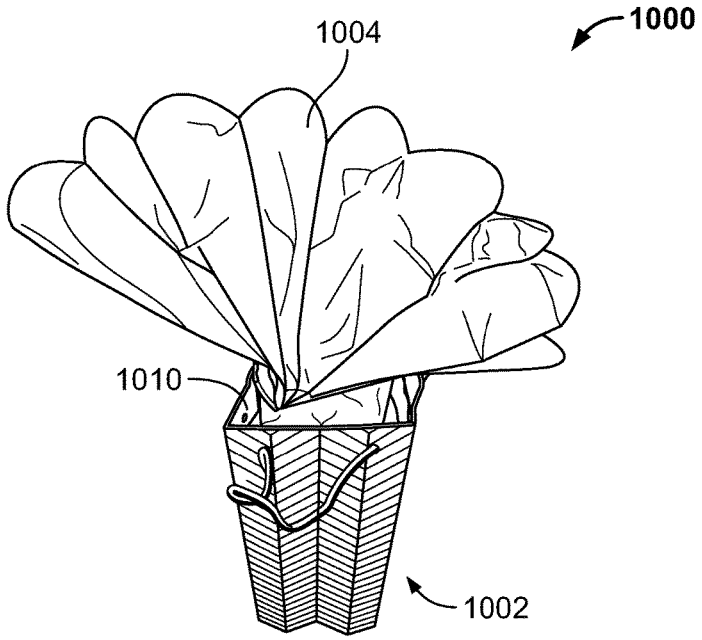
FIGS. 10B and 10C show the system of FIG. 10A with expandable members in partially (FIG. 10B) and fully (FIG. 10C) expanded configurations.
Figure 10C:
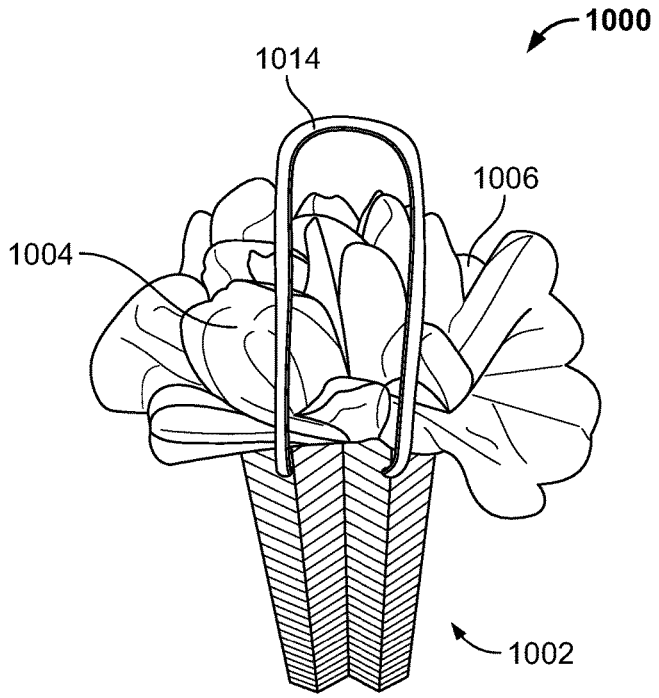

In other variations, a packaging system may comprise one or more expandable members fixed to a receptacle at an end of the expandable member, with the expandable member in a vertical orientation. That is, the end of the expandable member fixed to the receptacle may be fixed to the receptacle near the top opening of the receptacle, and in the collapsed configuration the expandable member may extend downwards into the receptacle. The expandable member may be folded upwards in order to move into an expanded configuration. This vertical configuration may be desirable, for example, in variations in which a receptacle has a small width and depth—for example, a bag configured to hold a bottle of wine or a small jewelry box. For example, FIGS. 10A-10C show a packaging system 1000 comprising a receptacle comprising a bag 1002 configured to hold a bottle of wine. The packaging system 1000 may comprise two expandable members 1004, 1006 installed vertically in the bag 1002. In the variation shown there, each expandable member comprises two layers of tissue paper, although more or fewer layers of material, and/or a different material may be used. As shown in a collapsed configuration in FIG. 10A, the first expandable member 1004 may be attached by its end to a left side 1010 of the bag 1002. The second expandable member 1006 may be attached by its end to a right side 1012 of the bag 1002. FIG. 10B shows the first expandable member 1004 in an expanded configuration, and FIG. 10C shows both the first and second expandable members 1004, 1006 in expanded configurations, with the two layers of each expandable member separated, as described in more detail herein. FIG. 10C also shows handle 1014 in an extended position, illustrating how the handle extends above the top of the expandable members when the expandable members are in an expanded configuration, as described in more detail herein. In other variations, a packaging system may comprise a single expandable member attached to the receptacle in a vertical orientation.

It should be appreciated that in other variations of the packaging systems described herein, a receptacle may have any suitable number of expandable members, and the expandable members may be attached in various locations on the receptacle. In some variations, a receptacle may have one or more expandable members attached to each side. In other variations, one or more sides of a receptacle may not have an expandable member attached to it. The expandable members may be attached horizontally, and/or they may be attached vertically. As an example, in some variations, a receptacle comprising a rectangular cross-section and an open top may have an expandable member attached at each of the four corners. As another example, a receptacle comprising a square cross-section may comprise an expandable member attached to each of its four sides. These configurations may be desirable, for example, in variations in which a receptacle has approximately equal width and depth.

The expandable members described herein may be attached to a receptacle in any suitable manner, examples of which are described herein. In some variations, an expandable member may be irreversibly attached to the receptacle (i.e., the expandable member is not intended to be removed from the receptacle and cannot easily be detached from the receptacle without damaging the expandable member and/or the receptacle in such a way that the same or a different expandable member may be reattached to the receptacle), whereas in other variations an expandable member may be removably attachable to the receptacle. When an expandable member is removably attachable to a receptacle, a pre-installed expandable member may be removed from the receptacle and reattached or replaced with a different expandable member, or a receptacle and corresponding expandable member may be separately obtained and then later assembled.

When an expandable member is attached to the receptacle, all sections of the plurality of sections of the expandable member may be fixed together at at least one location. The expandable member may be fixed to the receptacle at at least that same location. As described above, in some variations that location may be the midpoint along the length of the expandable member. In other variations, that location may be at or near the end of the length of the expandable member. As a result, the section of the expandable member against the inside surface of the receptacle is not the only section that has at least one point fixed relative to the receptacle. Rather, every section of the expandable member may be fixed relative to the receptacle at at least one point, and the location of that point may be the same for every section. Put another away, each section of the expandable member (i.e., not just the back surface of the expandable member configured to contact the receptacle) may be fixed to the receptacle at a single attachment point. As such, the expandable member may be able to radially expand about the attachment point, as described in more detail herein.

Figure 7:
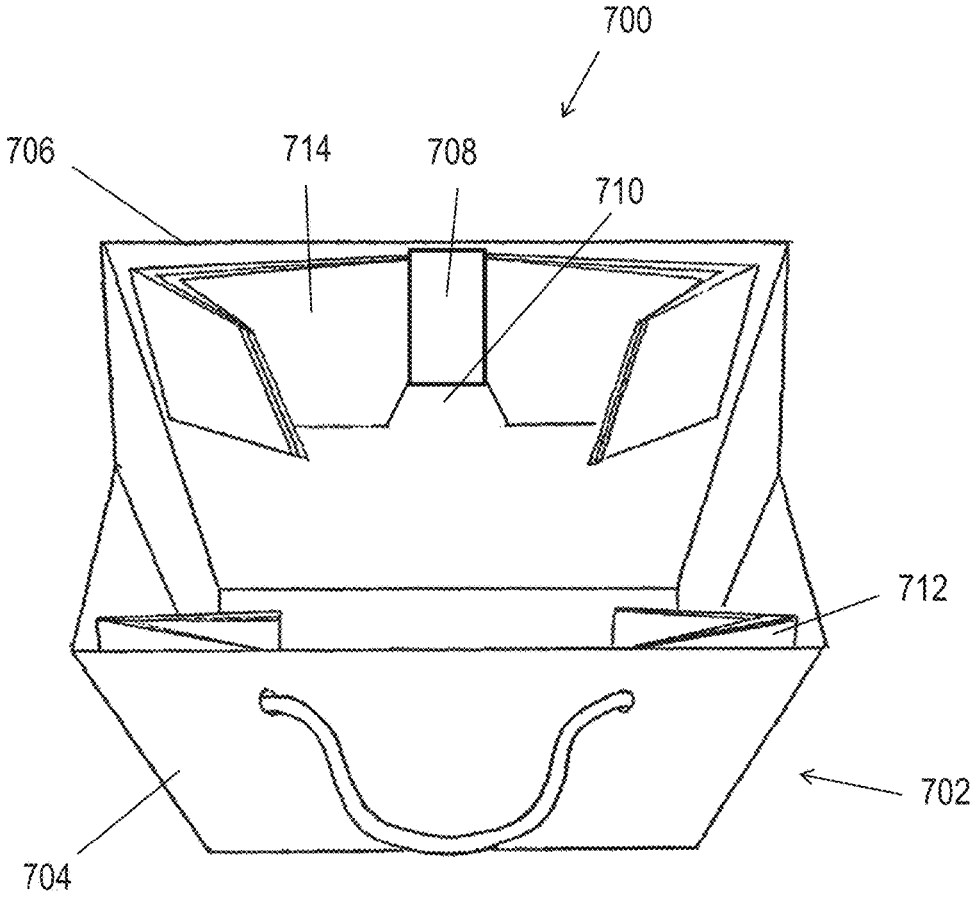
FIG. 7 shows a variation of a packaging system having an expandable member with a cut-away region.

The expandable member may optionally comprise one or more features to help facilitate radial expansion about the attachment point. For example, FIG. 7 shows a packaging system 700 comprising expandable members 712, 714 attached to the front side 704 and back side 706, respectively, of a receptacle 702. The expandable members 712, 714, may be each accordion-folded into a plurality of sections, and all of the sections of each expandable member may be held together at an attachment point (as shown, by a cardstock band 708). As shown, the attachment point may be located at the midpoint of the expandable member. The cardstock band 708 may be attached to the receptacle 702 (e.g., to the interior surface of the side of the receptacle or to a turn-top of the receptacle). As shown in FIG. 7, the expandable members may comprise a region at the attachment point that is configured to allow the expandable member to more easily move from a collapsed configuration to an expanded configuration (described in more detail herein). For example, the expandable member may have a reduced-width region at the attachment point. In the variation shown in FIG. 7, this reduced-width region may be formed by a cut-away region 710 located below the attachment point. It should be appreciated that such a cut-away region may additionally or alternatively be located above the attachment point. This region may be cut away in each section of the expandable member as shown, or it may be cut away in a subset of the sections of the expandable member. The cut-away region may be have any suitable shape, such as but not limited to a trapezoid, rectangle, or V-shape. In other variations, an expandable member may comprise one or a plurality of vertical cuts through one or more sections of the expandable member near the attachment point in order to allow the expandable member to more easily move from a collapsed configuration to an expanded configuration. It should be appreciated that each expandable member described herein may comprise one or more cut-away regions and/or vertical cuts in order to allow the expandable member to move more easily from a collapsed configuration to an expanded configuration.

Figure 11A:
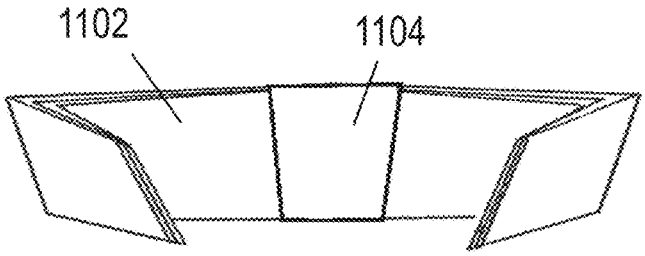
FIGS. 11A-11D show variations of expandable members held together by a cardstock band, a rubber band, magnets, and a tie, respectively.
Figure 11B:
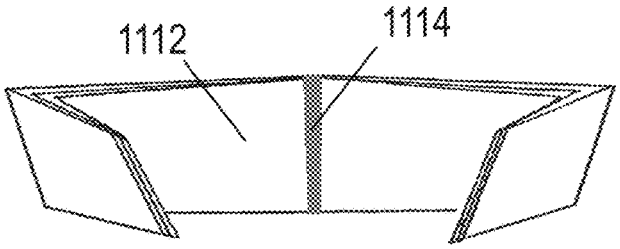
Figure 11C:
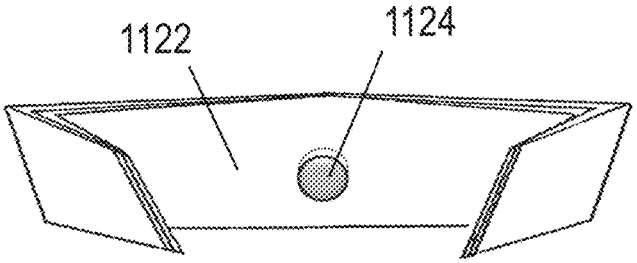
Figure 11D:
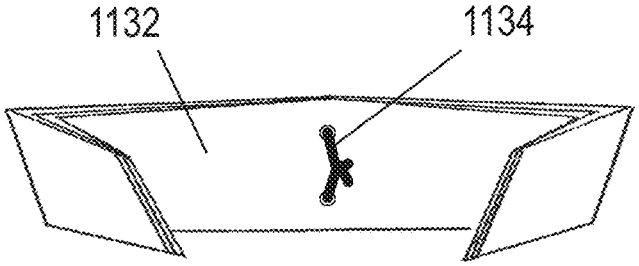

In some variations, the sections of the expandable member may be fixed together in a first manner, and then the expandable member may be fixed to the receptacle in a second manner. In other variations, the sections of the expandable member may be held together and secured to the receptacle using a single attachment feature. For example, in some variations the sections of the expandable member may be attached to each other via stitching through each section of the expandable member, as shown for example in FIG. 1A. In other variations, the sections of the expandable member may be attached to each other by adhesive, for example, glue or tape between each section. In other variations, the sections of the expandable member may be held together by an object that wraps around the expandable member. For example, the sections of the expandable member may be held together by an inelastic object that wraps around the expandable member. For instance, FIG. 11A shows an expandable member 1102 having sections held together by a band 1104 comprising cardstock that wraps around the expandable member. As another example, sections of the expandable member may be held together by an elastic object that wraps around the expandable member. For instance, FIG. 11B shows an expandable member 1112 having sections held together by a rubber band 1114. In yet other variations, the sections of the expandable member may be held together by compressive force. For example, FIG. 11C shows an expandable member 1122 having sections held together by magnets 1124 located on opposite sides of the expandable member. As another example, FIG. 11D shows an expandable member 1132 having sections held together by a tie 1134 (e.g., a tie comprising a thread, ribbon, twist tie, string, or the like) that extends through each section of the expandable member through one or more holes. In other variations, an expandable member may be held together by a clip, grommet, staple, pin, brad, or the like. In some variations, the attachment feature(s) may be concealed (e.g., by paper, an adhesive strip, ribbon, or the like).

Figure 11E:
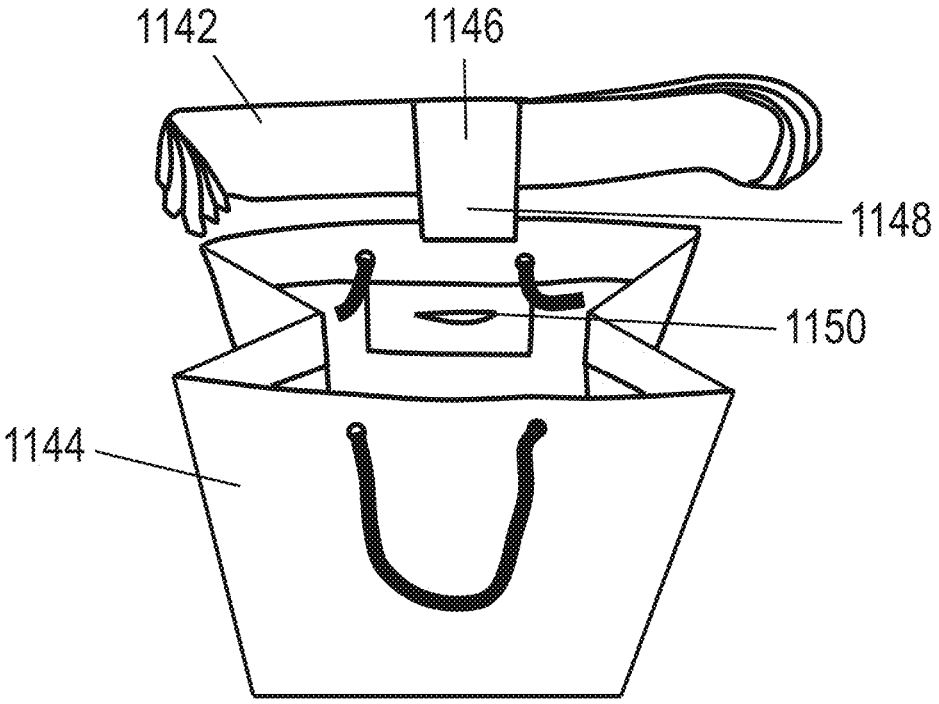
FIGS. 11E-11F show a variation of a packaging system comprising an expandable member that is reversibly attachable to a receptacle by a tongue and groove system.
Figure 11F:
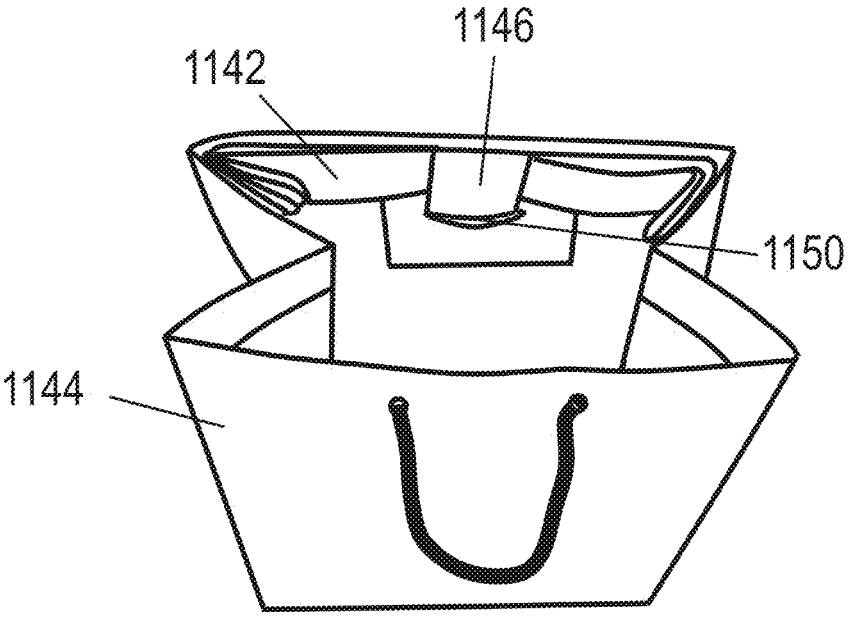

The expandable member with attached sections may be reversibly or irreversibly attached to the receptacle. For example, the expandable member may be irreversibly attached to the receptacle via stitching, adhesive (i.e., glue or tape), an object that extends through a portion of the receptacle (e.g., a turn-top) and through a portion of the expandable member (e.g., a staple, thread, ribbon, string, grommet, etc.), or the like. The expandable member may be reversibly attached to the receptacle via, for example, compressive force (e.g., from magnets, a clip), an object that extends through a portion of the expandable member and receptacle (e.g., a twist tie, pin, brad, thread, ribbon, string, etc.), a connection between the expandable member using a hook and loop fastener, a tie, a tab and a slot, a tongue and groove system, a snap, a screw system allowing the expandable member to be screwed onto the bag, or the like. FIGS. 11E-11F show an expandable member 1142 configured to be connected to a receptacle 1144 via a tongue and groove system. As shown there, the plurality of sections of the expandable member 1142 are held together by a band 1146 comprising cardstock that wraps around the expandable member, and that has a tab 1148 that extends below the expandable member. The tab 1148 in this variation is configured to fit into a slot 1150 against the side of the receptacle 1144, which reversibly secures the expandable member 1142 to the receptacle.

It should also be appreciated that in other variations, the sections of the expandable member may be fixed together and fixed to the receptacle using the same feature. For example, the expandable member may be sewn to the receptacle through all sections of the panel, thus fixing the sections to each other and to the receptacle. As another example, the expandable member may be attached to the receptacle via a feature extending through each section of the panel and through the receptacle (e.g., a twist tie, pin, brad, thread, ribbon, string, etc.). As yet another example, the expandable member may be attached to the receptacle and the sections of the expandable member may be fixed together via compressive force (e.g., from magnets, a clip).

Figure 12A:
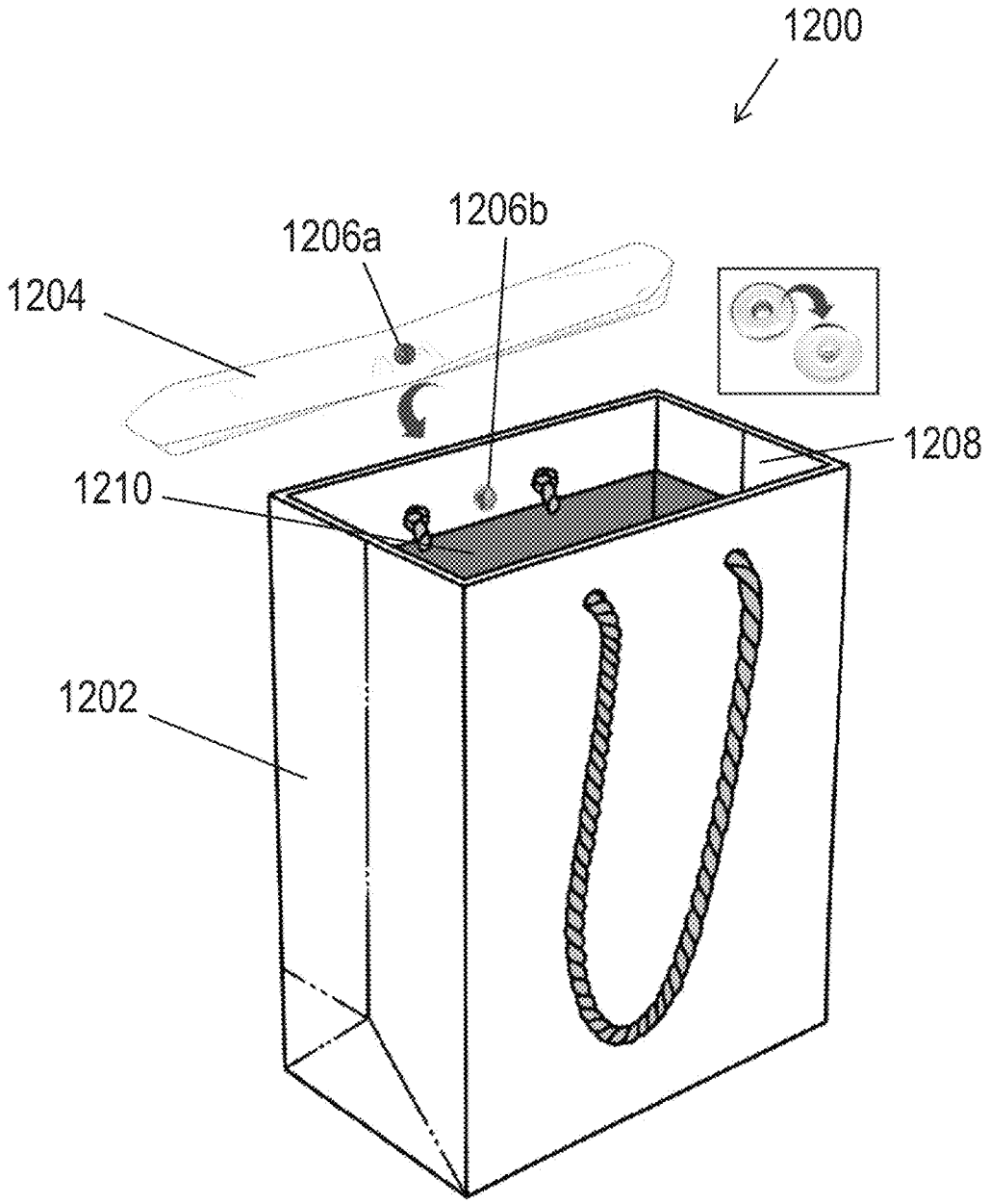
FIGS. 12A-12B show a variation of a packaging system comprising an expandable member that is reversibly attachable to a receptacle by a snap.

FIG. 12A shows an example of a packaging system 1200 comprising a receptacle comprising a bag 1202 and an expandable member 1204. The expandable member 1204 shown there is configured to be reversibly attachable to the bag 1202 via a snap 1206. A first portion 1206*a* of the snap (e.g., a socket portion of the snap) may be attached to the expandable member 1204, while a second portion 1206*b* of the snap (e.g., a stud portion of the snap) may be attached to the bag 1202 (e.g., to the turn-top 1208 of the bag). In the variation shown in FIG. 12A, the first portion 1206*a* and second portion 1206*b* of the snap are located at the midpoint of the expandable member 1204 and back side 1210 of the bag 1202, respectively, such that the midpoint of the expandable member is fixed to the midpoint of the back side of the bag when the expandable member is reversibly attached to the bag. The snap 1206 may allow the expandable member 1204 and bag 1202 to be initially separate, and then the expandable member may subsequently be attached to the bag. The snap 1206 may also allow the expandable member 1204 to be removed from the bag 1202, for example, to attach a different expandable member to the bag.

Figure 12B:
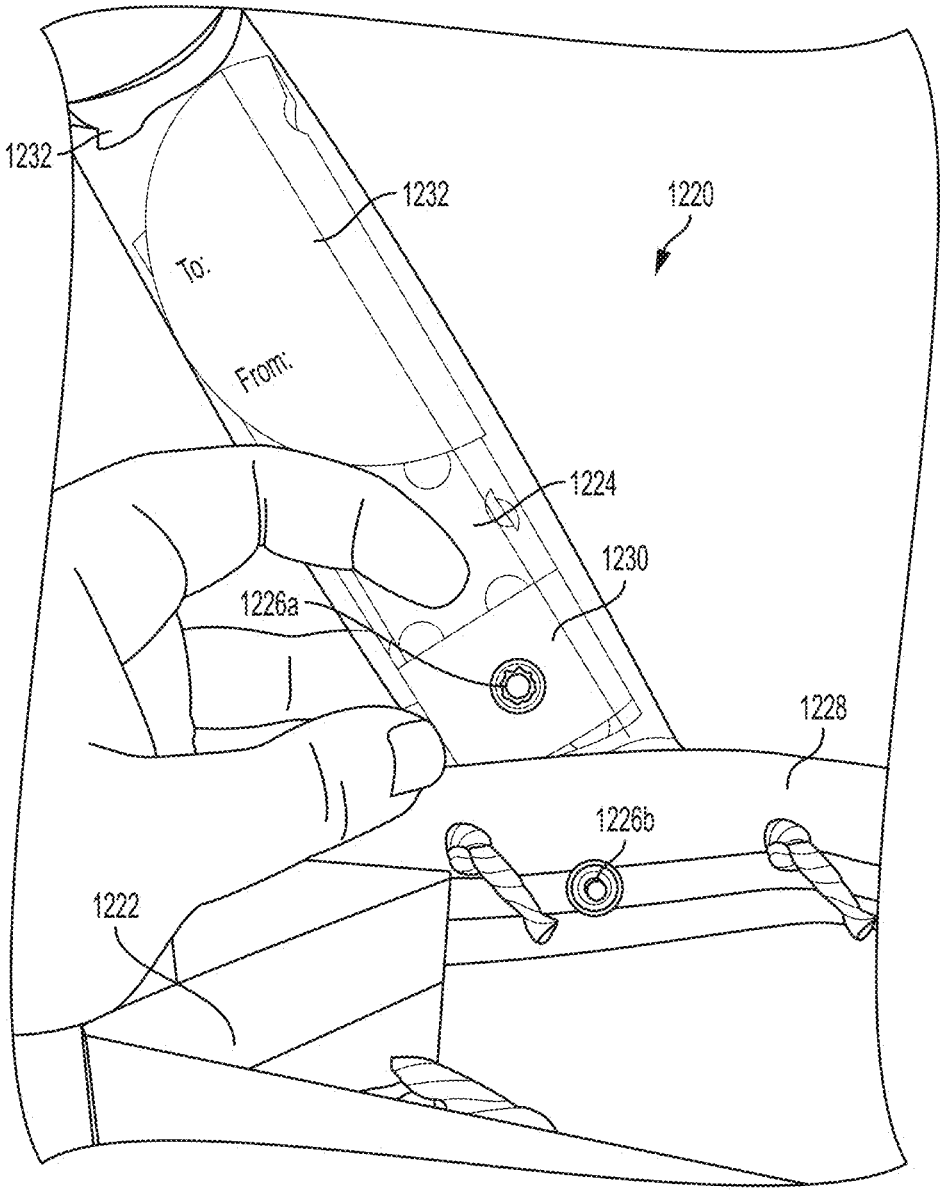

In some variations, an expandable member comprising a portion of the snap may be packaged separately from a receptacle comprising an opposing portion of the snap, and may also optionally be packaged with a hang tag. The hang tag may be configured to be reversibly attachable to a handle of the receptacle. FIG. 12B shows an exemplary packaging system 1220 comprising a bag 1222 and an expandable member 1224. A first portion of a snap 1226 (e.g., a stud portion 1226*b*) may be attached to a turn-top 1228 of the bag 1222. A second portion of the snap (e.g., a socket portion 1226*a*) may be attached to the expandable member 1224. The expandable member 1224 may be packaged in a collapsed configuration, with a cardstock band 1230 wrapped around each section of the of the expandable member (e.g., each section of accordion-folded tissue paper). The portion of the snap 1226*a* may be attached to the cardstock band 1230. The cardstock band 1230 may reinforce and protect the material of the expandable member (e.g., the tissue paper) near the snap. The expandable member 1224 may be folded and located within packaging 1232, which may also contain a hang tag 1234. To use the packaging system 1220, the expandable member 1224 and hang tag 1234 may be removed from the packaging 1232, and the expandable member 1224 may be removably attached to the bag 1222 via the snap 1206. The hang tag 1234 may also be removably attached to the bag (e.g., to a handle of the bag). The expandable member 1224 may then be moved from a collapsed configuration to an expanded configuration, as described in more detail herein. The packaging system 1220 may be reused with a different expandable member by removing the expandable member 1224 and attaching a different expandable member also having a portion of a snap. The hang tag 1234 may also be removed and replaced with a new hang tag.

In other variations, an expandable member may be configured to be reversibly attachable to a receptacle using magnetic elements. A first magnetic element may be attached to the expandable member, while a second magnetic element may be attached to the receptacle (e.g., to the turn-top of a bag). In some variations, the first and second magnetic elements may be located at the midpoint of the expandable member and a back side of the receptacle, respectively, such that the midpoint of the expandable member may be fixed to the midpoint of the back side of the receptacle when the expandable member is reversibly attached to the receptacle. The use of magnetic attachment may allow the expandable member and receptacle to be initially separate, and then the expandable member may subsequently be attached to the receptacle. The use of magnetic attachment may also allow the expandable member to be removed from the receptacle, for example, to attach a different expandable member to the bag. In some variations, both the first and second magnetic elements may be permanent magnets. In other variations, one of the first and second magnetic elements may be a permanent magnet, and the other may be a material, such as a metal, that is attracted to a magnetic field.

In should be appreciated that in variations in which an expandable member is reversibly attachable to a receptacle, when a first expandable member is detached from a receptacle, it may be replaced by an expandable member having a different appearance. For example, a second expandable member with a different color, pattern, shape, or material may be used to replace the first expandable member. This may, for example, allow a receptacle to be reused for a different occasion for which a different appearance is desired.

Ends

Figure 13A:
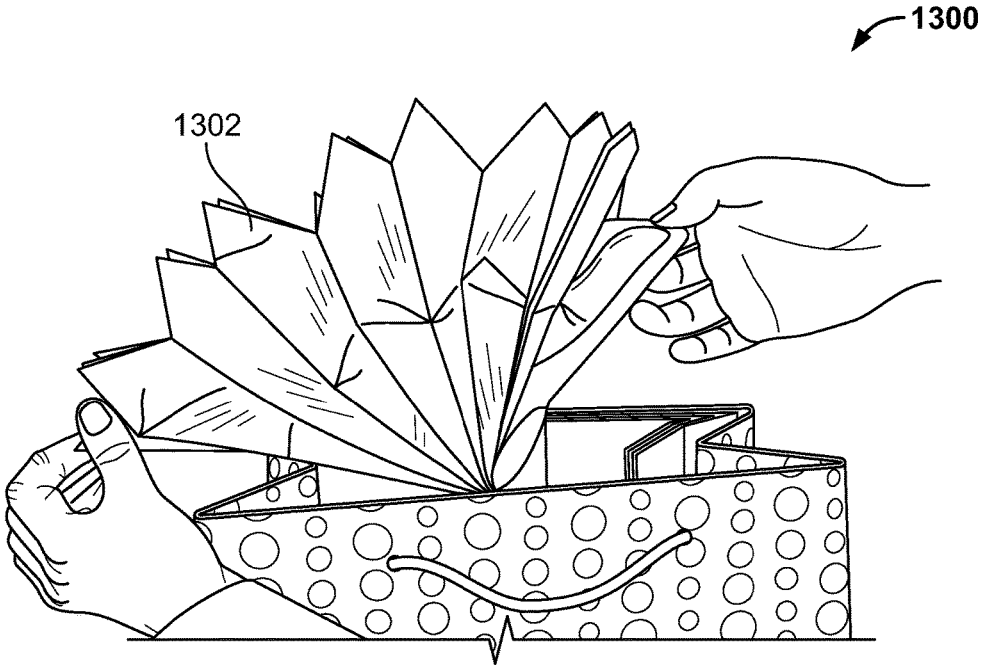
FIG. 13A shows a portion of a variation of a packaging system comprising an expandable member having ends with a triangular shape.
Figure 13B:
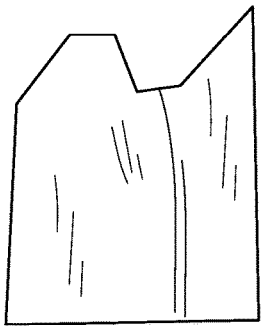
FIGS. 13B-13G show portions of expandable members having ends with various shapes in compressed and partially expanded configurations.
Figure 13C:
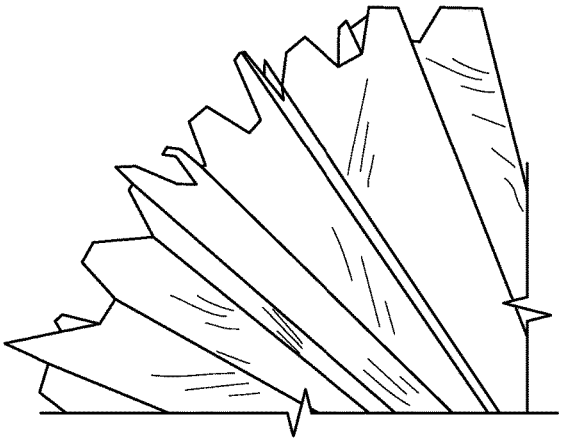
Figure 13D:
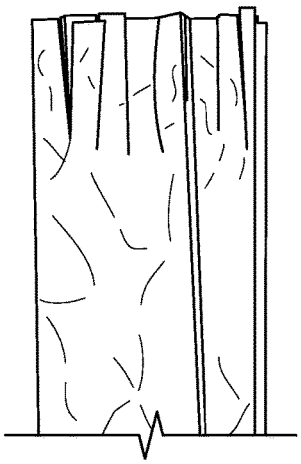
Figure 13E:
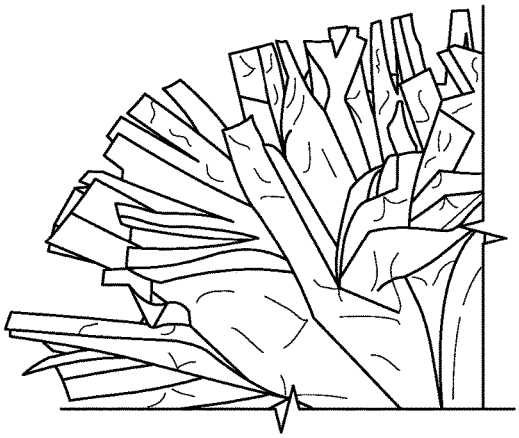
Figure 13F:
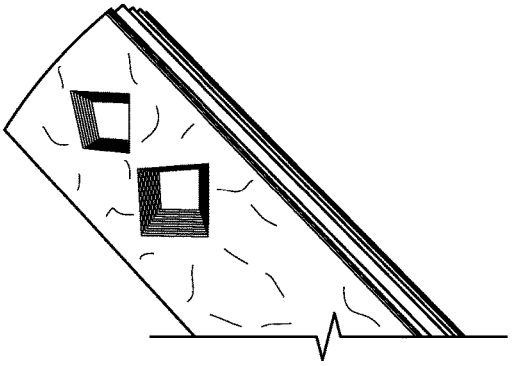
Figure 13G:
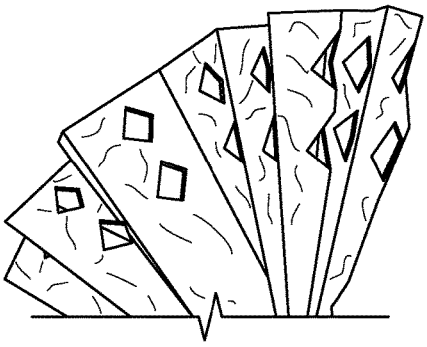

When an expandable member is attached to a receptacle as described herein, one or both of the ends of the expandable member may be movable relative to the receptacle, and may be configured to expand when the expandable member moves from the collapsed configuration to the expanded configuration, as described in more detail herein. These ends may in some instances be cut into a decorative shape. For example, the ends may be cut to have a rectangular, rounded, scalloped, quatrefoil, curvilinear triangular, triangular, fringe, or zig-zag shape, or the like. In some variations, the ends may additionally or alternatively have cut-outs having one or more shapes, such as a cut-outs having elliptical, oval, square, rectangular, triangular, trapezoid, pentagon, hexagon, octagon, parallelogram, rhombus crescent, heart, spade, or diamond shapes, or the like. For example, FIG. 13A shows a portion of a packaging system 1300 comprising an expandable member 1302 having ends comprising triangular shapes. As another example, FIGS. 10B-10C show an expandable member 1004 having an end with a rounded scalloped shape. Other examples are shown in FIGS. 13B-13G, which show ends with a repeating pattern of geometric shapes comprising a trapezoid and a triangle (FIG. 13B, compressed, and FIG. 13C, partially expanded), fringes (FIG. 13D, compressed, and FIG. 13E, partially expanded), and diamond cut-outs (FIG. 13F, compressed, and FIG. 13G, partially expanded). The decorative shape may be achieved using any suitable method, such as but not limited to die cutting. In some variations, the decorative shape may be chosen to match a pattern on the receptacle, to reflect a design associated with a particular brand, or to reflect the usage of the receptacle (e.g., for a gift bag, the gifting occasion). For example, it may in some instances be desirable for a packaging system for holding a wedding gift to have the loose ends of each expandable member cut into a rounded shape, while it may in some instances be desirable for a packaging system for holding a birthday gift to have the loose ends of each expandable member cut into a triangular shape.

Collapsed and Expanded Configurations

As mentioned briefly above, the expandable members described herein may be configured to be moved between a collapsed configuration (as shown, for example, in FIGS. 1A, 3A-3B, 5A, 6A, 7, 8A, 9, 10A, 11F, 15A-15D, 17A, 18A, 19A, and 20A) and an expanded configuration (as shown, for example, in FIGS. 1B, 3A-3B, 10B-10C, 14D, and 15E-15G). In a collapsed configuration, an expandable member may be compressed, such that it lies flat against the interior surface of the receptacle. In an expanded configuration, a expandable member may be expanded to extend out of the opening of a receptacle and above the top of the receptacle, in order to create decorative appearance and to conceal the contents of the receptacle. In the expanded configuration, the top opening of the receptacle may remain open. That is, the top opening of the receptacle may not be closed, such as by, for example, a feature attached to opposite sides of the receptacle to form a cover. Instead, the expandable member may obscure the view through the top opening of the receptacle without securing or closing the opening (i.e., if the receptacle were turned upside down, an object within the receptacle would be able to fall out through the top opening).

Rather than simply extending around the perimeter of the top opening of the receptacle, the expandable member(s) in the expanded configuration may fill the space within and above the top opening. Moreover, the systems described herein are configured such that the majority of the material of an expandable member in an expanded configuration may be located above the top of the opening of the receptacle. For example, in some variations, at least 50% of the material of an expandable member in the expanded configuration may be located above the top of the opening of the receptacle. In some variations, at least 60% of the material of an expandable member in the expanded configuration may be located above the top of the opening of the receptacle. In some variations, at least 70% of the material of an expandable member in the expanded configuration may be located above the top of the opening of the receptacle. In some variations, at least 80% of the material of an expandable member in the expanded configuration may be located above the top of the opening of the receptacle. Indeed, in some variations of packaging systems comprising a receptacle comprising a turn-top, the expandable member(s) may be entirely located at or above the turn-top, in both the expanded and collapsed configurations.

Figure 15A:
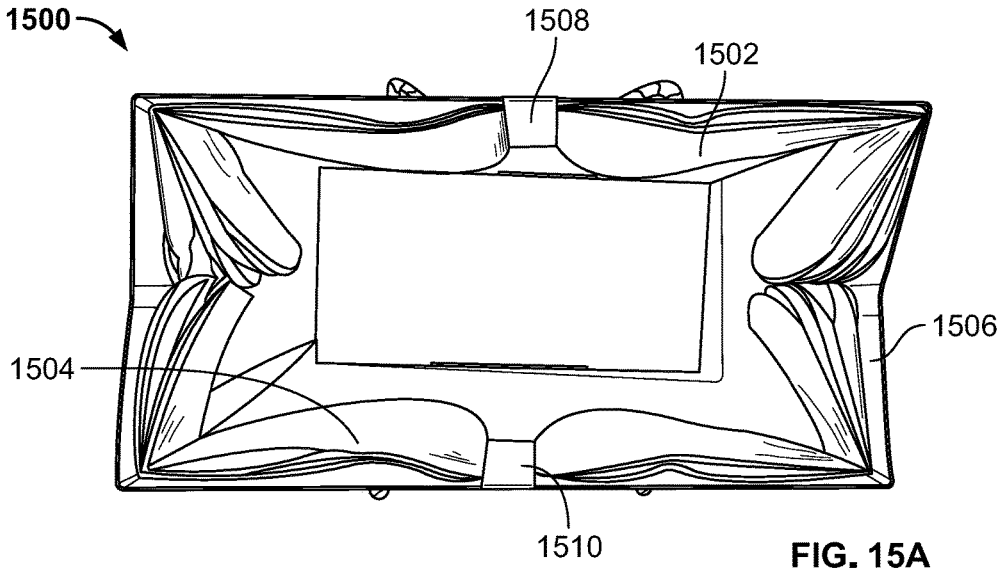
FIGS. 15A-15G show a variation of a packaging system with expandable members in collapsed configurations (FIGS. 15A-15D) and expanded configurations (FIGS. 15E-15G).
Figure 15B:
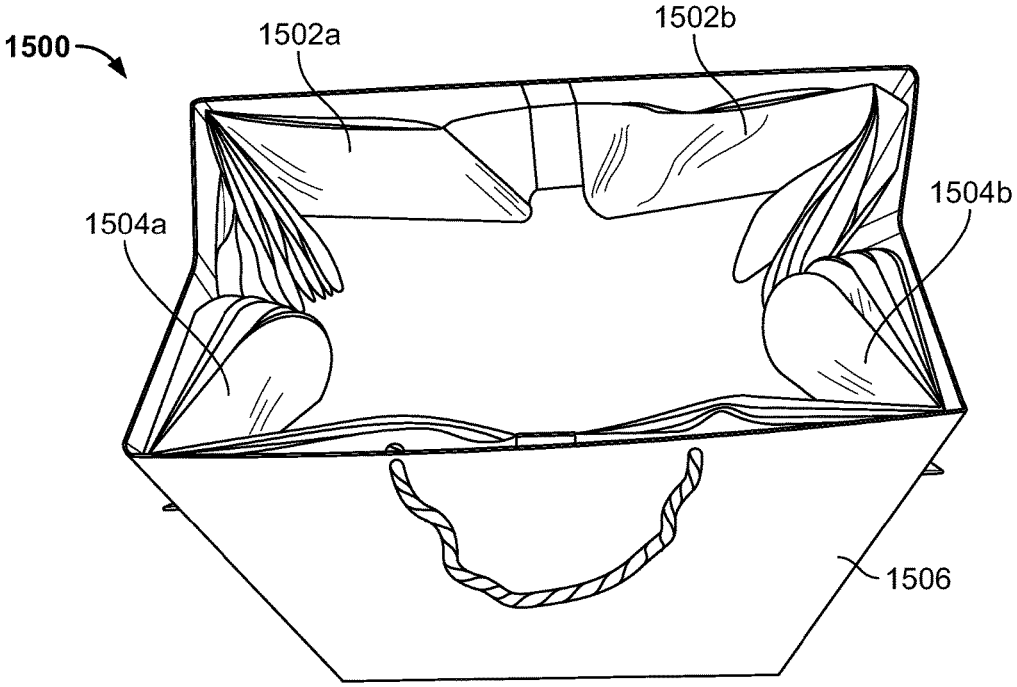
Figure 15C:
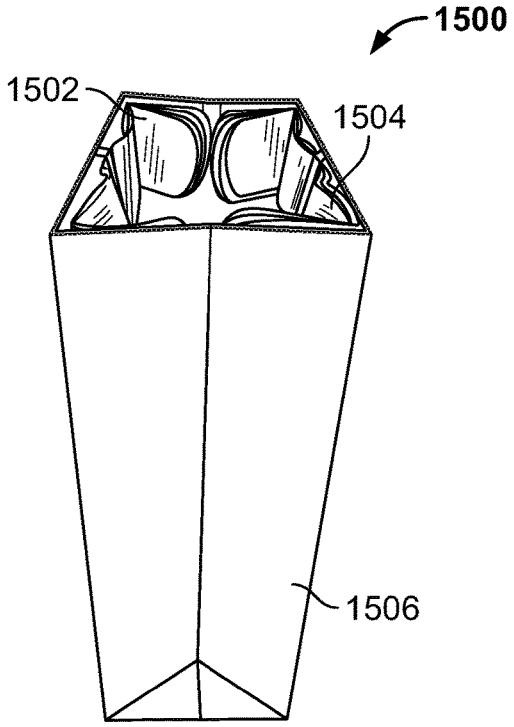
Figure 15D:
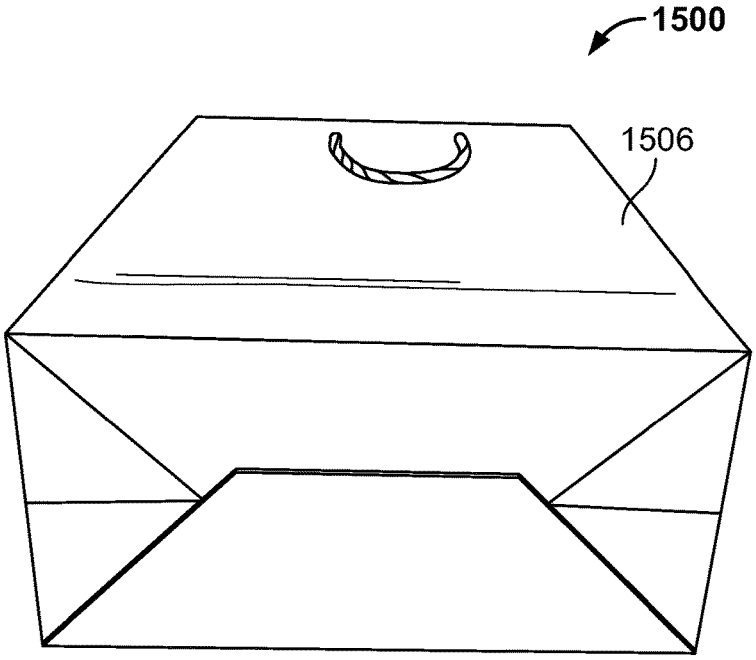
Figure 15E:
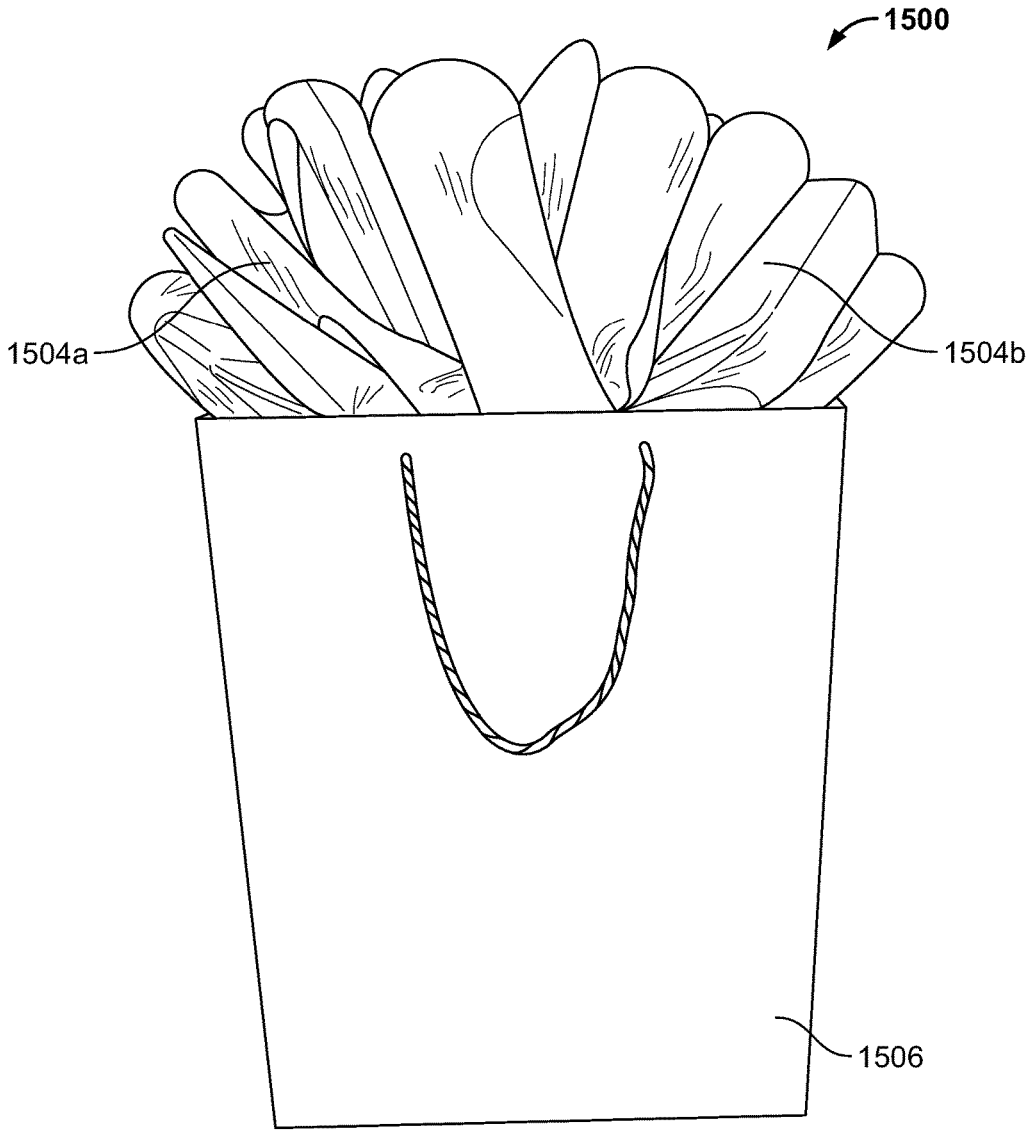
Figure 15F:
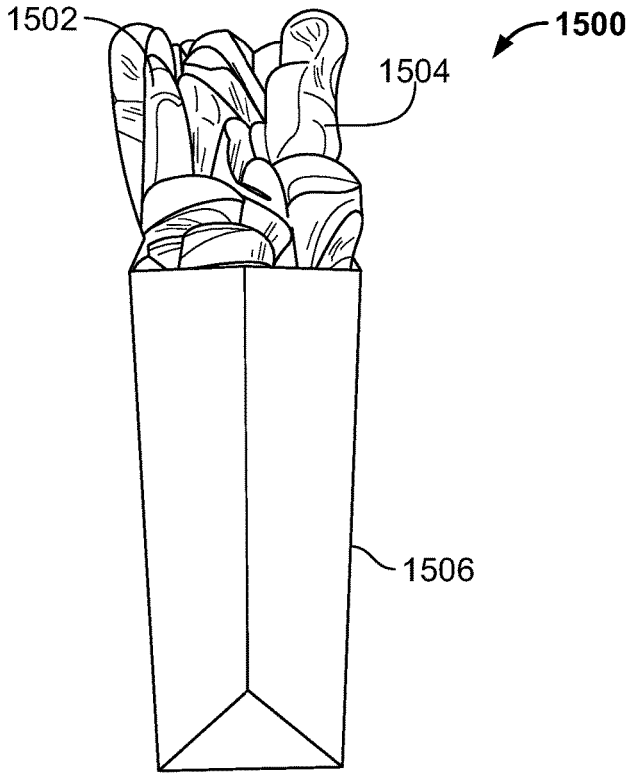
Figure 15G:
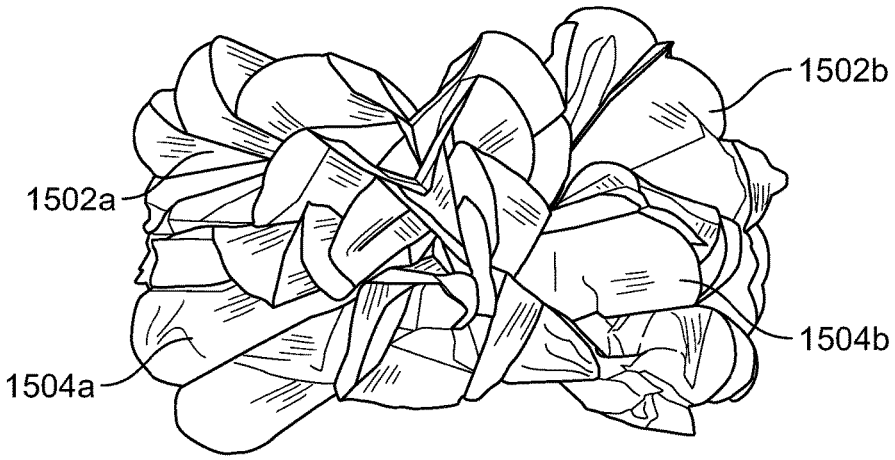

The packaging systems described herein may be configured such that the orientation of an expandable member changes between the collapsed and expanded configurations. For instance, a packaging system 1500 is shown in FIGS. 15A-15G with expandable members in collapsed configurations (FIGS. 15A-15D) and expanded configurations (FIGS. 15E-15G). FIGS. 15A, 15B, 15C, and 15D show top, perspective front, perspective side, and perspective bottom views, respectively of the packaging system 1500 with expandable members in collapsed configurations. As shown there, in the collapsed configuration, expandable members 1502, 1504 may be accordion-folded into a plurality of sections separated by a plurality of folds. In each expandable member, all of the plurality of sections may be fixed together at an attachment point by a band 1508 or 1510, which may comprise for example cardstock. The attachment point may be located at the midpoints (lengthwise) of the expandable members. Band 1508 may separate expandable member 1502 into a left side 1502*a* and right side 1502*b*, and band 1510 may separate expandable member 1504 into a left side 1504*a* and a right side 1504*b*. The bands 1508, 1510 may be in turn attached to a turn-top of a receptacle comprising a bag 1506, where the bag 1506 comprises a top opening formed by the top edges of the sides of the bag. Each expandable member 1502, 1504 may be fixed to the bag (e.g., to the turn-top of the bag) via the midpoint (lengthwise) of the expandable member just below the top opening of the receptacle, such that the entirety of each expandable member may be located within the receptacle in a collapsed configuration. As shown, when the expandable members are in collapsed configurations, each fold along the length of the expandable members 1302, 1304, as well as the length of each section of the expandable members, may lie parallel to the top opening of the receptacle (i.e., parallel to the top edges of the sides of the receptacle).

FIGS. 15E, 15F, and 15G show front, side, and top views, respectively, of the packaging system 1500 with the expandable members 1502, 1504 in expanded configurations. As shown there, in the expanded configuration, each side of the each expandable member may be radially expanded upwards about the attachment point. That is, left sides 1502*a*, 1504*a* of the expandable members may be radially expanded clockwise about the attachment point, and the right sides 1502*b*, 1504*b* of the expandable members may be radially expanded counterclockwise about the attachment point. As can be seen in FIGS. 15A-15B, the expandable members 1502, 1504 may each comprise a cut-away region below their attachment points, so as to facilitate radial expansion. Turning back to FIGS. 15E-15G, unlike in the collapsed configuration, in the expanded configuration the folds along the length of the expandable members 1502, 1504 may not lie parallel to the top opening of the receptacle. Similarly, the length of each section of the expandable members 1502, 1504 may not lie parallel to the top opening of the receptacle. Rather, the folds and the sections of the expandable members 1502, 1504 may extend in a radial pattern from the attachment point. In the expanded configuration, the portions of the expandable members 1502, 1504 near the attachment point may be located within the receptacle (i.e., below the top opening of the receptacle), but the other portions of the expandable members may be located outside of the receptacle, above the top opening of the receptacle. In the expanded configuration, the portions of the expandable members 1502, 1504 above the top opening of the receptacle may form a shape that approximates a circular segment.

Figure 14A:
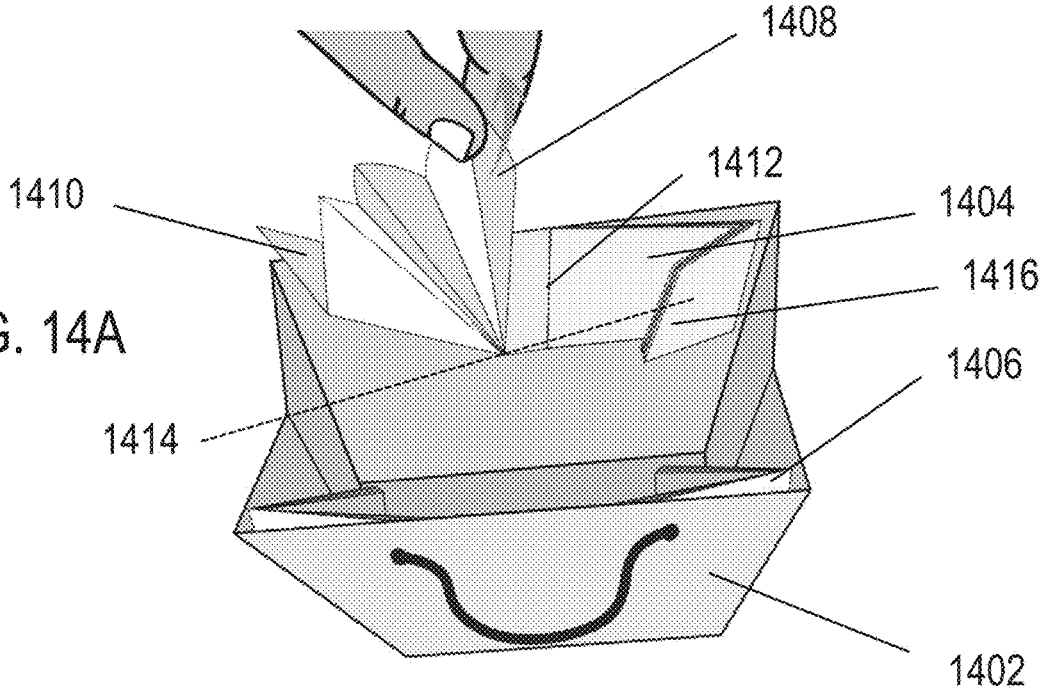
FIGS. 14A-14D show movement of a variation of an expandable member from a collapsed configuration to an expanded configuration.
Figure 14B:
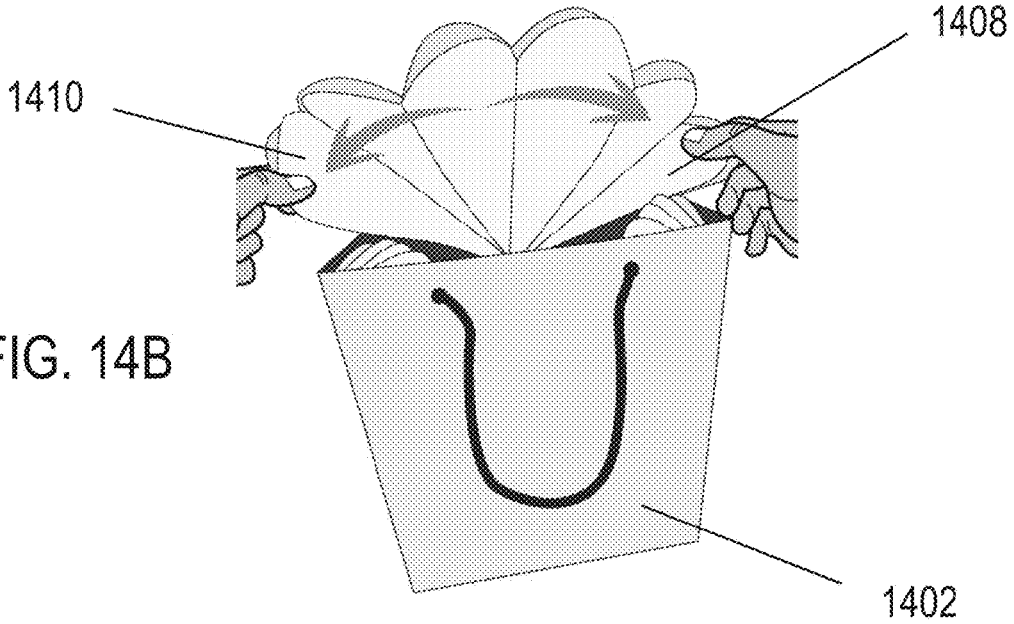

An example of movement of an expandable member from a collapsed configuration to an expanded configuration is shown in FIGS. 14A-14D. As shown in FIG. 14A, a user may grasp a first corner 1408 of the expandable member 1404 and pull the first corner away from a second corner 1410 of the expandable member. Corner 1408 may be moved along an arc centered at the point of attachment 1412 between the sections of the expandable member and the receptacle 1402. As such, the first corner 1408 may be moved away from the second corner 1410 and receptacle 1402, upwards and toward the midpoint of the expandable member 1404. At the same time, the second corner 1410 may optionally be grasped by the user to hold it in place or to pull it away from the first corner 1408. The result may be a partially expanded expandable member, in which half of the expandable member has been moved from a collapsed configuration to an expanded configuration, as shown in FIG. 14B.

Figure 14C:
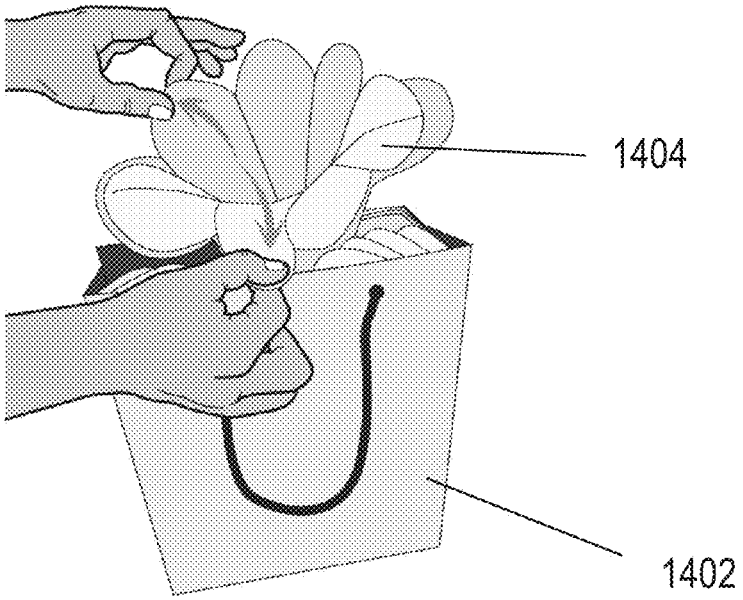

This procedure may be repeated on the second half of the expandable member. A user may grasp a third corner 1414 of the expandable member 1404 and pull the third corner away from a fourth corner 1416 of the expandable member. Corner 1414 may be moved along an arc centered at the point of attachment 1412 between the sections of the expandable member at the receptacle 1402. As such, the third corner 1414 may be moved away from the fourth corner 1416 and the receptacle 1402, upwards and toward the midpoint of the expandable member 1404, bringing the third corner 1414 toward the first corner 1408 in its expanded position. At the same time, the fourth corner 1416 may be optionally grasped by the user to hold it in place or to pull it away from the third corner 1414. The result may be a fully expanded expandable member 1404, in which both halves of the expandable member have been moved from a collapsed configuration to an expanded configuration. In variations in which the expandable member 1404 comprises two or more layers of material, the two or more layers of material may be optionally separated, as shown in FIG. 14C.

Figure 14D:
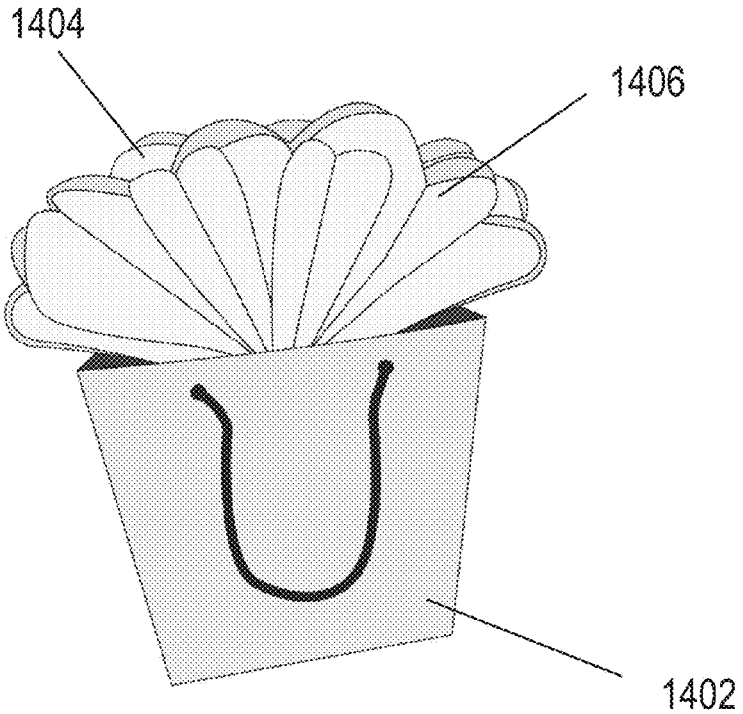

As described herein, the receptacle 1402 may comprise a second expandable member 1406 attached to an interior surface of the receptacle, opposite the first expandable member 1404. The steps described above may be repeated with the second expandable member 1406, such that both expandable members are in an expanded configuration, as shown in FIG. 14D. A similar method may be used to expand the other variations of expandable members described herein.

It should be appreciated that in some variations, the packaging systems described herein may comprise one or more features configured to protect the expandable members while in a collapsed configuration. For example, the packaging systems may comprise one or more sleeves (e.g., plastic sleeves) configured to fit over a portion of the expandable member in the collapsed configuration. The sleeves or other features may be configured to be removed prior to expansion of the expandable member to the expanded configuration.

While FIGS. 14A-14D show the expandable members being manually moved from a collapsed configuration to an expanded configuration by a user directly grasping the expandable member, in other variations the packaging systems may comprise one or more features to assist with movement from a collapsed configuration to an expanded configuration. For instance, in some variations the expandable members may comprise one or more cords (e.g., string, rope, ribbon, thread, or the like) attached to the expandable member (i.e., to a corner of the expandable member), such that a user may pull on the cord in order to move the expandable member from the collapsed configuration to the expanded configuration. A portion of the expandable member opposite the cord may but need not be fixed to the receptacle (e.g., to the turn-top of a bag) in order to hold the portion of the expandable member in place while the cord is pulled. In some variations, the cord may be connected to or may be part of a handle of the receptacle, as described in more detail herein.

Figure 16A:
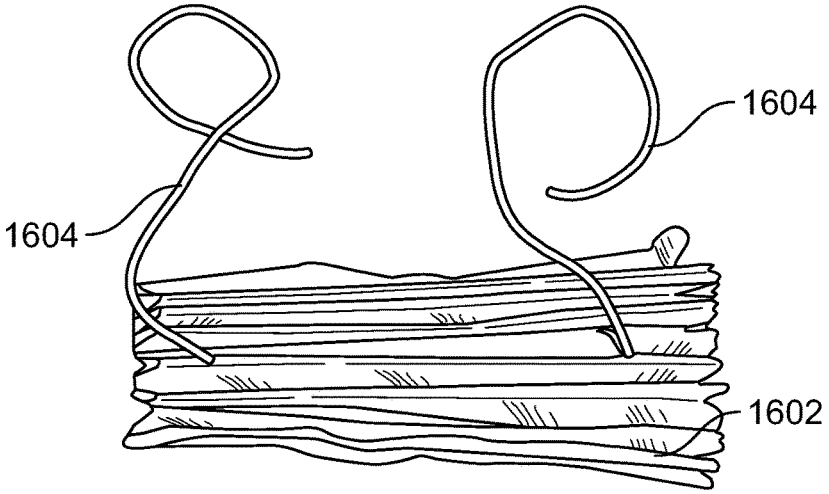
FIG. 16A shows a variation of an expandable member comprising pull cords.
Figure 16B:
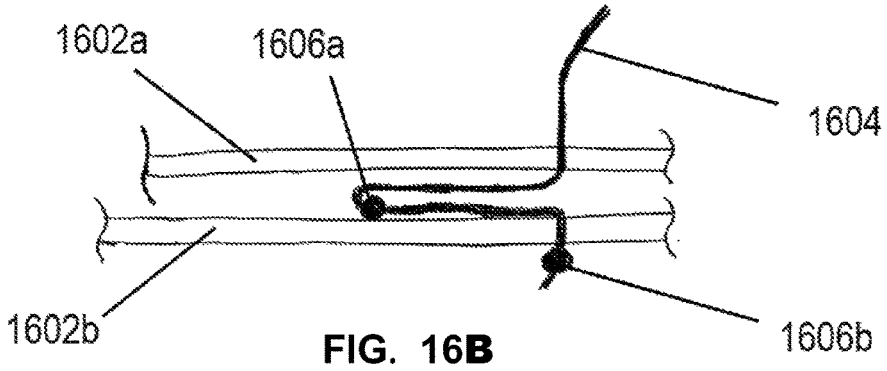
FIGS. 16B-16C show partial cross-sections of the expandable member of FIG. 16A in first and second configurations.
Figure 16C:
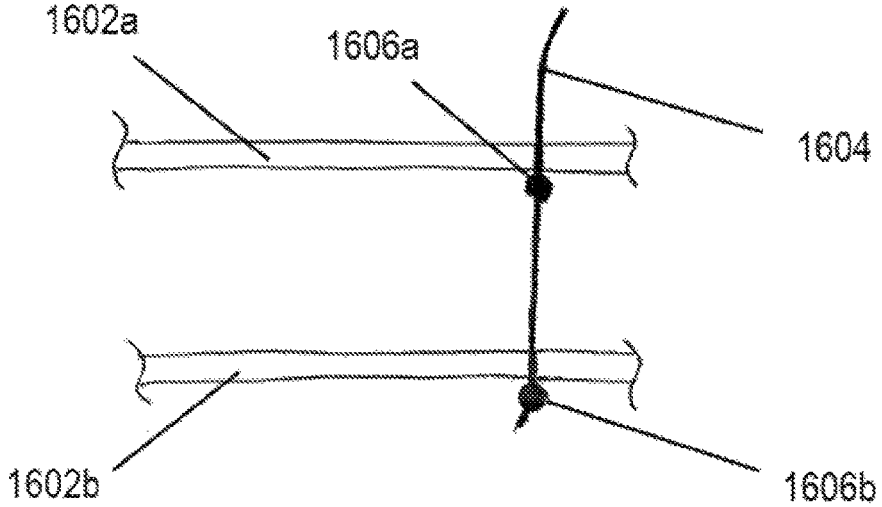

In one variation, a cord may be located at a center point within the expandable member. For example, FIG. 16A shows an accordion-folded expandable member 1602 having two cords 1604 attached to the expandable member at a central fold of the expandable member. When an expandable member comprises more than one layer of material (e.g., two layers of tissue paper), a cord may be attached to each layer of material. In some instances, the cord may be attached to each layer of material such that when the cord is used to expand the expandable member, the layers of material move away from each other, i.e., from an adjacent configuration to a separated configuration. For example, FIGS. 16B and 16C show a partial cross-section of the expandable member 1602. The expandable member 1602 comprises a first layer of material (here, tissue paper) 1602*a* and a second layer of material (here, tissue paper) 1602*b*. As shown, cord 1604 extends through each layer of material and comprises a stop corresponding to each layer of material. The stop may comprise any suitable feature, such as but not limited to a knot, bead, or adhesive. In the example shown, the stops comprise knots 1606*a* and 1606*b*. One end of the cord may be prevented from traveling through layer 1602*b* by knot 1606*b*. In an adjacent configuration, shown in FIG. 16B, the two layers of material 1602*a* and 1602*b* may be adjacent to each other, with a segment of the cord 1604 including knot 1606*a* located between the layers of material. In a separated configuration, shown in FIG. 16C, the cord 1604 may be pulled upward, such that knot 1606*a* is pulled adjacent to layer 1602*a* and the layers 1602*a* and 1602*b* are separated by a length of the cord. It should be appreciated that in other variations, the knots 1606*a* and 1606*b* may be replaced by other suitable features that limit movement of the cord relative to the layers of material.

Figure 17A:
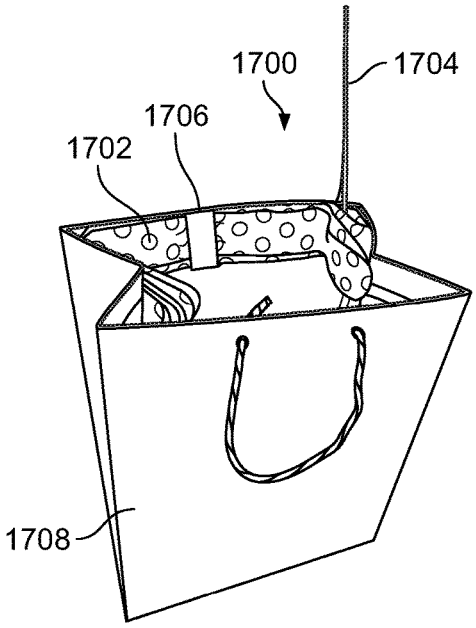
FIGS. 17A-17D show a variation of a packaging system comprising an expandable member comprising pull cords.
Figure 17B:
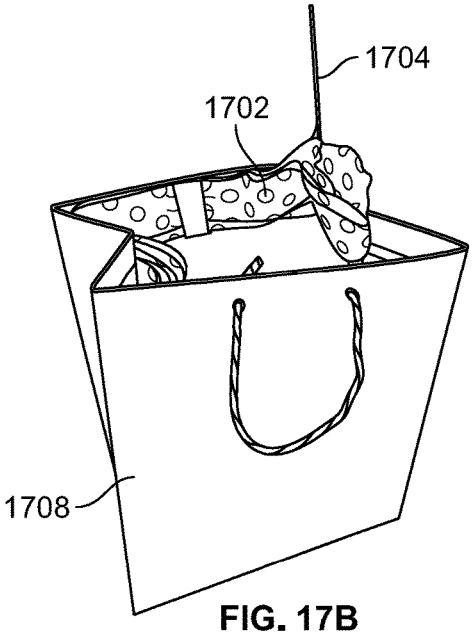
Figure 17C:
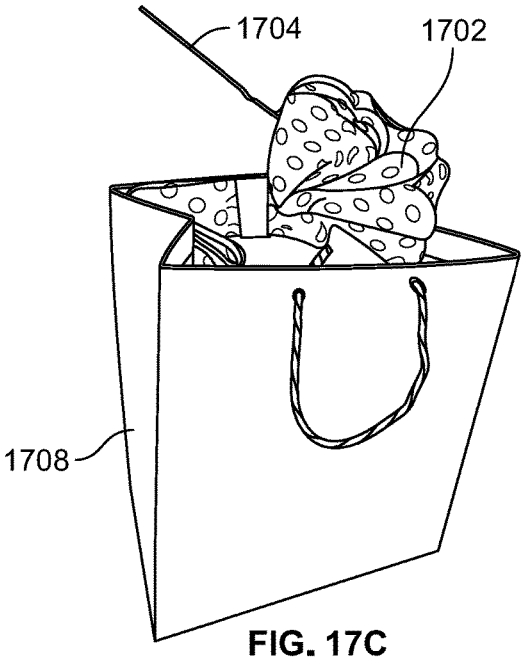
Figure 17D:
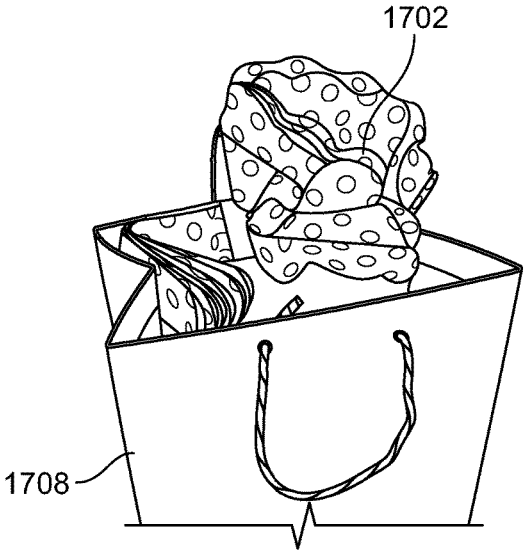

An example of a packaging system 1700 comprising such a cord is shown in FIGS. 17A-17D. Shown there is expandable member 1702 similar to expandable member 1602 attached to a bag 1708. Expandable member 1702 may be accordion-folded into a plurality of sections, which may be held together at their midpoint by a band 1706, and the band 1706 may be attached to the turn-top of the bag 1708. A first cord 1704 and a second cord (not shown) may extend through the expandable member 1702 on each side of the band 1706. The cord 1704 may extend through the expandable member 1702 at a central fold of the expandable member and near the outer end of the length of the expandable member. The cord 1704 may be pulled to move the expandable member 1702 from a collapsed configuration to an expanded configuration. The cord 1704 may first be pulled upwards, as shown in FIG. 17B, and then may be pulled at an angle upwards and toward the midpoint of the expandable member 1702, as shown in FIG. 17C, in order to pull the expandable member in an arc. A similar procedure may be carried out using the second cord to expand the second half of the expandable member. It should be appreciated that one or more portions (e.g., corners) of the expandable member may but need not be fixed to the receptacle (e.g., to the turn-top of the bag) in order to hold the portion of the expandable member in place while the cord is pulled.

In yet other variations, the packaging system may be configured such that a handle can be used to move an expandable member from a collapsed configuration to an expanded configuration. In some of these variations, when the expandable member is a collapsed configuration, the handle may be in a retracted configuration. When the handle is pulled from a retracted configuration to an extended configuration, the movement of the handle may cause the expandable member to move from a collapsed configuration to an expanded configuration. The handle may do so by having an end fixed relative to a movable portion of the expandable member. The handle may further have an end fixed relative to the receptacle. When the handle is pulled, the expandable member may be pulled into an expanded configuration.

Figure 18A:
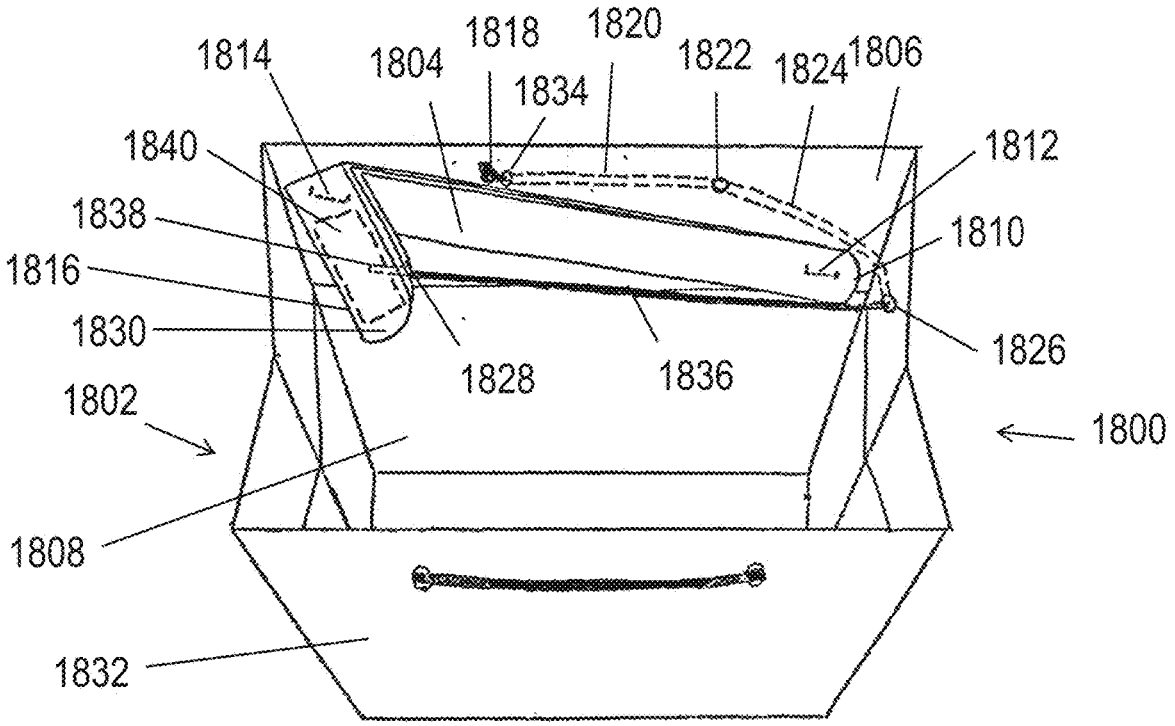
FIGS. 18A-18B show a variation of a packaging system comprising a handle configured to move an expandable member from a collapsed configuration to an expanded configuration.
Figure 18B:
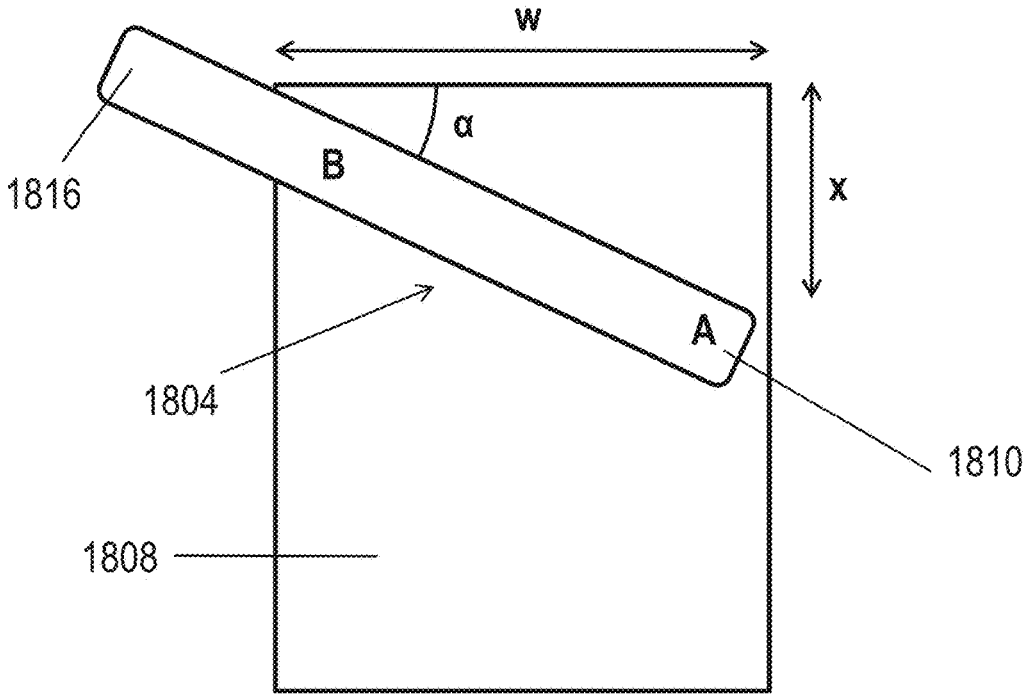

An example is shown in FIGS. 18A-18B. As show in FIG. 18A, a packaging system 1800 comprises a receptacle comprising a bag 1802, a first expandable member 1804, and a second expandable member (not shown). The expandable member 1804 may be attached to a turn-top 1806 of the bag 1802 on a front 1832 or back 1808 side of the bag. In order for the handle-based deployment system to function property, it is desirable that the expandable member 1804 be attached to the bag 1802 in a particular orientation relative to the top opening of the bag. More particularly, the expandable member 1804 should not be installed parallel to the top opening of the bag 1802. Rather, the expandable member 1804 may be installed at an angle α relative to the top opening of the bag 1802. An isolated schematic of the back side 1808 of the bag 1802 is shown in FIG. 18B. The expandable member 1804 is shown oriented at an angle α relative to the top opening of the bag 1802. At point A, a first end 1810 of the expandable member 1804 is attached to the bag 1802 (e.g., to the turn-top of the bag) such that the expandable member is at a distance x from the top of the bag, near the right edge of the back side 1808. At point B, a location between the two ends (lengthwise) of expandable member 1804, the expandable member is attached to the bag 1802 (e.g., to the turn-top 1806 of the bag) such that the expandable member near point B is at the top of the bag. As such, the distance x is equal to the width w of the back side 1808 of the bag 1802 multiplied by tan(a).

It may be desirable that the expandable member 1804 be installed at an angle α relative to the top opening of the bag 1802 of at least about 15 degrees. In some variations, the expandable member 1804 may be installed at an angle α relative to the top opening of the bag 1802 of between about 15 degrees and about 45 degrees. In some variations, the expandable member 1804 may be installed at an angle α relative to the top opening of the bag 1802 of between about 15 degrees and about 25 degrees. In some variations, the expandable member 1804 may be installed at an angle α relative to the top opening of the bag 1802 of about 15 degrees, about 20 degrees, about 25 degrees, about 30 degrees, about 35 degrees, about 40 degrees, or about 45 degrees. An angle α relative to the top opening of the bag in this range may allow the expandable member to open in the desired orientation when the handle is pulled, as described in more detail herein. As shown in FIG. 18B, the second end 1816 of the expandable member 1804 may extend beyond the left edge of the back side 1808, and thus may be folded inward to fit within the bag 1802, as shown in FIG. 18A.

At point A shown on the schematic of FIG. 18B, each section of the expandable member 1804 may be attached to the bag 1802, while at point B, only one section (i.e., the section next to the bag) may be attached to the bag. That is, at its lowest point within the bag 1802, all sections of the expandable member 1804 may be fixed relative to the bag. In the drawing of FIG. 18A, it can be seen that all sections of the expandable member 1804 are fixed to the bag 1802 by staple 1812 that extends through the expandable member. (It should be appreciated that alternatively, any suitable fixation feature may be used.) At its highest point within the bag (i.e., at the opening), only one section of the expandable member 1804 may be fixed relative to the bag, and the remainder may be movable relative to the bag. This may allow the two corners near end 1816 of the accordion-folded expandable member 1804 to be moved away from each other during expansion. In the drawing of FIG. 18A, it can be seen that only one section of the expandable member 1804 is attached to the bag 1802 by staple 1814. This allows corners 1828 and 1830 to be moved away from each other during expansion.

In an initial collapsed configuration, corners 1828 and 1830 may be adjacent to one another (separate by the intervening sections of the accordion-folded expandable member 1804). One end of the handle may be attached to corner 1828, and movement of the handle may be used to pull corner 1828 away from corner 1830. The handle may be configured such that when moved from a retracted configuration to an extended configuration, the handle pulls the corner 1828 along a similar pathway as the one along which a user would manually move the corner in order to expand the expandable member 1804, i.e., in an arc toward the opposite, first end of the expandable member 1810.

In order to achieve this effect, in one variation shown in FIG. 18A, a first end 1818 of the handle may be attached to the bag 1802 near the top opening of the bag. For example, the first end 1818 may extend through a hole 1834 in the back side 1808 of the bag 1802 and adjacent turn-top 1806, with a knot on the interior of the bag to hold the handle in place. A second end 1838 of the handle may be attached to the corner 1828 of the expandable member 1804. When the expandable member comprises a thin material, such as tissue paper, the second end 1838 of the handle may be attached to a reinforcement panel 1840 (e.g., cardstock) attached to corner 1828.

Between the first 1818 and second 1838 ends of the handle, the handle may extend through a series of holes or other fixed points (e.g., loops or slots). These holes or other fixed point may be configured to redirect the handle such that extension of the handle pulls the movable corner of the expandable member from the left side of the receptacle toward the right side of the receptacle, as viewed in FIG. 18A. In the variation shown in FIG. 18A, a portion 1820 of the handle may extend from hole 1834 along the outside of the bag 1802 and into the bag through a hole 1822 in the back side 1808 of the bag. Hole 1822 may extend only through the back side 1808 and not through the turn-top 1806, such that a portion 1824 of the handle is located between the outer sides of the bag and the turn-top. The handle may exit the space between the outer sides of the bag and the turn-top into the interior of the bag at hole 1826, which is located in the right side of the turn-top 1806 (that is, on the opposite side of the interior of the bag from the movable corner 1828 of the expandable member). A portion 1836 of the handle may extend across the interior of the bag from the right side of the bag to the second end 1838 of the handle, which may be attached to corner 1828 of the expandable member. Each of the holes 1834, 1822, and 1826 may be located at approximately the same height as each other, an may also be located at approximately the same height at which a section of the expandable member is attached to the bag (i.e., the height of staple 1814, or referring to FIG. 18B, the height of point B).

In some variations, it may be desirable for the packaging system to comprise one or more reinforcement features to reinforce the receptacle when the handle is pulled. While optional, this may be especially desirable when the receptacle does not comprise a rigid material. For example, the packaging system 1800 may optionally comprise a reinforcement feature near the corner of the bag 1802, between holes 1822 and 1826. For example, the reinforcement feature may comprise a brace located in the corner of the bag 1802. As another example, the reinforcement feature may comprise tubing or another suitable channel through which the portion 1824 of the handle may travel.

In the example of FIGS. 18A-18B, when the portion 1820 of the handle is pulled from a retracted configuration to an extended configuration, the end 1838 of the handle may be moved toward hole 1826, which in turn may pull corner 1828 away from corner 1830 and toward end 1810 of the expandable member 1804. As such, the expandable member 1804 may be moved from the collapsed configuration shown in FIG. 18A to an expanded configuration. The expandable member may also be recompressed (i.e., moved from an expanded configuration to a collapsed configuration after being expanded) by moving corner 1828 away from end 1810 and back toward corner 1830, and in doing so moving the handle back to a retracted configuration.

Figure 19A:
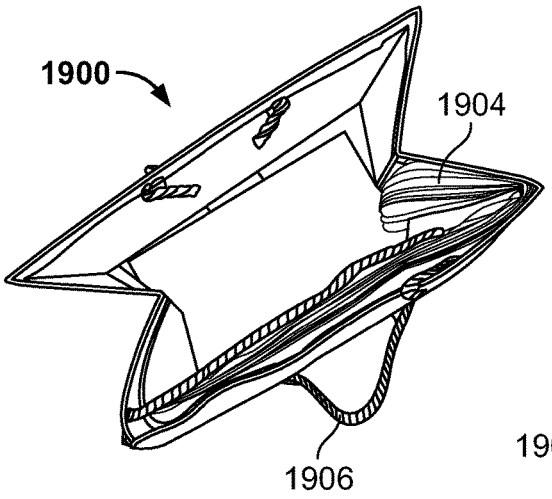
FIGS. 19A-19C show movement of an expandable member from a collapsed configuration to an expanded configuration using a handle configured to move the expandable member.
Figure 19B:
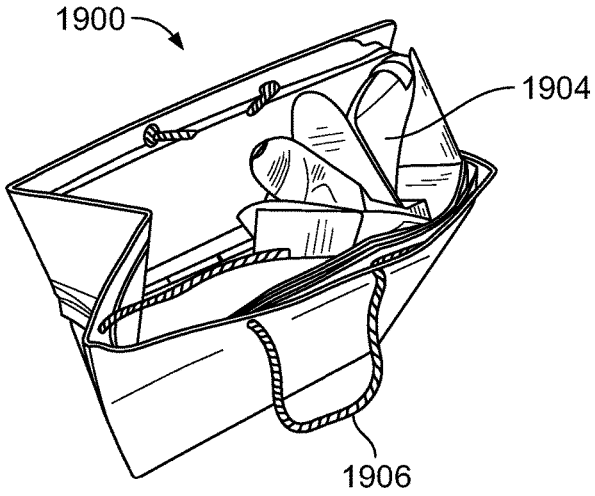
Figure 19C:
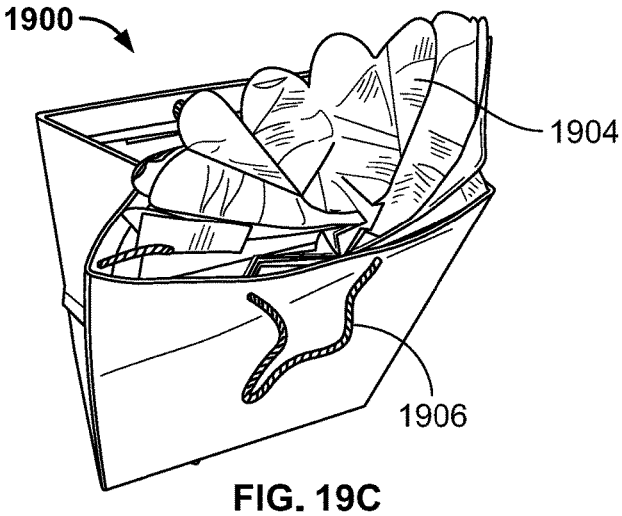

Another example of a packaging system comprising a handle configured to move an expandable member from a collapsed configuration to an expanded configuration is shown in FIGS. 19A-19C. Shown there is a packaging system 1900 similar to that of FIGS. 18A-18B. An expandable member 1904 is shown being moved from a collapsed configuration (FIG. 19A) to an expanded configuration by pulling on handle 1906. It should be appreciated that while packaging system 1900 is shown comprising a single expandable member 1904, it may comprise one or more additional expandable members. For example, a second expandable member may be attached to the opposite side of the receptacle, and may be configured to be moved from a collapsed configuration to an expanded configuration by pulling on a second handle.

Although the foregoing invention has been described in some detail by way of illustration and example for purposes of clarity of understanding, it will be readily apparent to those of ordinary skill in the art in light of the teachings of this invention that certain changes and modification may be made thereto without departing from the spirit and scope of the appended claims. To the extent that certain features and variations that have been described with respect to specific embodiments herein, it should be appreciated that the features and variations may be contemplated with respect to other embodiments described herein as appropriate.

The invention claimed is:

1. A packaging system, comprising:

a receptacle comprising a bottom, a first side, a second side, a third side, a fourth side, and a top opening, wherein the first side opposes the second side and both have a first width, and wherein the third side opposes the fourth side and both have a second width;

a first expandable member attached horizontally to an interior surface of the first side of the receptacle; and a second expandable member attached horizontally to an interior surface of the second side of the receptacle, wherein the first and second expandable members each comprise a first corner, a second corner, a third corner, and a fourth corner, and a length between the first corner and the third corner, wherein the length is approximately equal to the sum of the first width and the second width, and wherein the first and second expandable members each have a collapsed configuration and an expanded configuration, wherein in the collapsed configuration each expandable member is accordion-folded into a plurality of sections with the first corner near the second corner and the third corner near the fourth corner, and wherein in the expanded configuration, the first corner is spaced radially away from the second corner and the third corner is spaced radially away from the fourth corner, and wherein in the expanded configuration the first and second expandable members obscure a view through the top opening while the top opening remains open.

2. The packaging system of claim 1, wherein each of the plurality of sections is fixed to the receptacle at a midpoint along the length of the expandable member.

3. The packaging system of claim 2, wherein each of the expandable members is removably attached to the receptacle.

4. The packaging system of claim 3, wherein each of the expandable members is removably attached to the receptacle via a snap.

5. The packaging system of claim 2, wherein the ratio of the first width measured in inches to the number of sections in the plurality of sections is about 1:1.

6. The packaging system of claim 1, wherein the expandable members comprise tissue paper.

7. The packaging system of claim 1, wherein the expandable members comprise tulle.

8. A packaging system, comprising:

a receptacle comprising a bottom, a first side, a second side, and a top opening, wherein the first side opposes the second side and both have a first width;

a first expandable member attached to an interior surface of the first side of the receptacle, wherein the first expandable member comprises first and second ends; and a second expandable member attached to an interior surface of the second side of the receptacle, wherein the second expandable member comprises first and second ends, and wherein the first and second expandable members each have a collapsed configuration and an expanded configuration, wherein in the expanded configuration each expandable member partially extends out of the top opening, and in the collapsed configuration each expandable member is located within the receptacle and is accordion-folded into a plurality of sections each having a second width and a length, wherein the ratio of the first width measured in inches to the number of sections is about 1:1, and wherein the ratio of the first width to the length is less than 1:1.

9. The packaging system of claim 8, wherein each of the plurality of sections of the first expandable member is attached to a first location on the first side of the receptacle, and wherein each of the plurality of sections of the second expandable member is attached to a second location on the second side of the receptacle.

10. The packaging system of claim 9, wherein a midpoint between the first and second ends of the first expandable member is attached to a midpoint of the first side of the receptacle, and wherein a midpoint between the first and second ends of the second expandable member is attached to a midpoint of the second side of the receptacle.

11. The packaging system of claim 8, wherein each of the plurality of sections of the first expandable member is attached to the first side of the receptacle at the first end of the first expandable member, and wherein each of the plurality of sections of the second expandable member is attached to the second side of the receptacle at the first end of the second expandable member.

12. The packaging system of claim 11, wherein a section of the first expandable member adjacent to the first side of the receptacle is attached to the first side of the receptacle at a location spaced between the first and second ends of the first expandable member, and wherein a section of the second expandable member adjacent to the second side of the receptacle is attached to the second side of the receptacle at a location spaced between the first and second ends of the second expandable member.

13. The packaging system of claim 12, further comprising a handle comprising a first end and a second end, wherein the second end is attached to the second end of the first expandable member, and wherein the handle comprises a retracted configuration and an extended configuration, and wherein the handle is configured such that movement of the handle from the retracted configuration to the extended configuration moves the first expandable member from the collapsed configuration to the expanded configuration.

14. The packaging system of claim 8, wherein the second width is about 2.5 inches.

15. The packaging system of claim 8, wherein in the expanded configuration, at least about 50% of each expandable member extends out of the top opening of the receptacle.

* * * * *